US012757980B1

(12) United States Patent
Lin et al.

(10) Patent No.: US 12,757,980 B1
(45) Date of Patent: Oct. 13, 2026

(54) ANTI-SLIP STRUCTURE, SHOE SOLE AND ALLICATIONS THEREOF

(71) Applicant: Jinjiang Xinming shoe material Technology Co., LTD., Quanzhou (CN)

(72) Inventors: Shubiao Lin, Quanzhou (CN); Surong Lin, Quanzhou (CN)

(73) Assignee: Jinjiang Xinming shoe material Technology Co., LTD., Quanzhou (CN)

( * ) Notice: Subject to any disclaimer, the term of this patent is extended or adjusted under 35 U.S.C. 154(b) by 0 days.

(21) Appl. No.: 19/414,245

(22) Filed: Dec. 9, 2025

(30) Foreign Application Priority Data

Apr. 15, 2025 (CN) ..... 202510471764.7
Apr. 15, 2025 (CN) ..... 202520710690.3

(51) Int. Cl.
*A43C 15/16* (2006.01)

(52) U.S. Cl.
CPC ..... *A43C 15/161* (2013.01); *A43C 15/167* (2013.01); *A43C 15/168* (2013.01)

(58) Field of Classification Search
CPC ..... A43B 15/14; A43B 15/161; A43B 15/167; A43B 15/168
USPC ..... 36/61
See application file for complete search history.

(56) References Cited

U.S. PATENT DOCUMENTS 3,566,489 A * 3/1971 Morley ..... A43C 15/161 36/67 D
4,159,582 A * 7/1979 Ostrowski ..... A43C 15/14 36/134
6,079,127 A * 6/2000 Nishimura ..... A43C 15/162 36/134
2006/0021254 A1* 2/2006 Jones ..... A43C 15/14 36/61
2008/0222924 A1 9/2008 Carruthers
2011/0047817 A1* 3/2011 Francello ..... A43C 15/14 36/61

(Continued)

FOREIGN PATENT DOCUMENTS

CN 102488353 A 6/2012
CN 106579642 A 4/2017

(Continued)

*Primary Examiner* — Ted Kavanaugh
(74) *Attorney, Agent, or Firm* — Sang Young Han

(57) ABSTRACT

The anti-slip structure comprises a body, on which an embedded replaceable shock-absorbing anti-slip device for shock absorption and anti-slip function is detachably arranged. This device comprises an embedded stud assembly, which comprises a guide member movably arranged up and down, a fixed base, and an anti-slip portion arranged between the guide member and the fixed base. The guide member is configured to guide and engage the shock-absorbing anti-slip device, the fixed base is configured to prevent detachment of the shock-absorbing anti-slip device, the anti-slip portion is configured to prevent slipping and grip the ground when contacting with the ground. The embedded stud assembly of the present invention can adapt to ground conditions. When coping with extreme terrains such as wet slippery rocks, muddy mountain trails, or frozen soil, the spring undergoes elastic deformation in response to changes in the center of gravity, absorbing shocks, enhancing comfort, and reducing foot fatigue.

20 Claims, 21 Drawing Sheets

(56) References Cited

U.S. PATENT DOCUMENTS

| | | | | |
|---|---|---|---|---|
| 2017/0035152 | A1* | 2/2017 | Wu | A43C 15/061 |
| 2019/0008232 | A1* | 1/2019 | Chaney | A43B 13/04 |
| 2026/0076444 | A1* | 3/2026 | Nguyen | A43B 13/026 |

FOREIGN PATENT DOCUMENTS

| | | | |
|---|---|---|---|
| CN | 218635431 | U | 3/2023 |
| JP | 10201502 | A | 8/1998 |
| JP | 2022098858 | A | 7/2022 |

* cited by examiner

ANTI-SLIP STRUCTURE, SHOE SOLE AND ALLICATIONS THEREOF

TECHNICAL FIELD

The present invention belongs to the technical field of shoe soles, and particularly relates to an anti-slip structure, shoe sole and applications thereof.

BACKGROUND

As the core component for contact between the human body and ground, shoe soles are widely applied in fields such as outdoor sports equipment, industrial protective footwear, and specialized operational equipment, providing users with grip, stability and protection. In extreme environments such as mountaineering, trail running, and snow exploration, the anti-slip performance of shoe soles directly relates to the life safety and operational efficiency of users. In such outdoor scenarios, the shoe sole must simultaneously address multiple complex terrains including ice and snow, wet slippery rocks, and muddy mountain paths, which poses higher requirements for anti-slip technology.

During snow expedition scenarios, existing climbing shoes, although strengthening grip on ice and snow terrain through steel stud implantation and serrated treads, still exhibit technical deficiencies. Fixed steel studs, while capable of temporarily embedding into ice surfaces, generate rigid collisions when contacting hard surfaces (such as exposed rocks and frozen ground), failing to adapt to the undulations of various terrains. This not only results in intense walking vibrations but also leads to foot fatigue during prolonged use. Furthermore, in cases where some steel stud assemblies are damaged, replacement becomes complex due to the studs being fixed to the shoe sole. In extreme environments where energy conservation is essential to meet extreme environmental challenges, rapid disassembly and adjustment cannot be performed, resulting in poor user experience.

As disclosed in the prior art, publication number TW200608911A also relates to footwear having anti-slip accessories, however such footwear requires manual adjustment of the shoe sole's extension and retraction to control the friction force against the ground, which is extremely inconvenient. Therefore, designing a shoe sole with an anti-slip structure to resolve the aforementioned problems is of particular importance.

SUMMARY (1) Technical Problems to be Solved

In order to resolve the aforementioned problems of the prior art, the present invention provides an anti-slip structure which, through the provision of an embedded replaceable shock-absorbing anti-slip device, can adapt to different athletic scenarios, facilitates replacement and disassembly, improves anti-slip and shock-absorbing capabilities, and provides adaptive shock absorption through elastic deformation variations to facilitate human movement.

The present invention further provides a shoe sole that can adaptively provide shock absorption for different uneven conditions in various sports scenarios through an anti-slip structure equipped with an embedded replaceable shock-absorbing anti-slip device, facilitating easy replacement and disassembly, improving anti-slip and shock-absorbing capabilities, and being easy to process.

The present invention further provides an application of the anti-slip structure for providing additional grip to the application body to prevent sliding.

(II) Technical Solution

To achieve the above objectives, the present invention is implemented through the following technical solution:

An anti-slip structure, characterized in that the anti-slip structure comprises a body, wherein the body is removably provided with an embedded replaceable shock-absorbing anti-slip device for shock absorption and anti-slip functions, which comprises an embedded stud assembly, the embedded stud assembly comprises a guide element movably arranged up and down, a fixed base and an anti-slip portion arranged between the guide element and the fixed base, the guide element being configured to guide and engage the shock-absorbing anti-slip device, the fixed base being configured to prevent detachment of the shock-absorbing anti-slip device, the anti-slip portion being configured to prevent slipping and grip the ground when contacting the ground.

Wherein comprises a first surface configured for contacting the ground and a second surface attached to the midsole of the shoe sole, the embedded replaceable shock-absorbing anti-slip device being arranged on the first surface of the body.

Wherein the first surface comprises anti-slip units extends from the body of the anti-slip structure toward the ground at a first height H1, for providing a first anti-slip force to enhance basic anti-slip capability.

Wherein at least one anti-slip unit comprises an anti-slip block, the anti-slip block having an engagement groove formed therein for detachably installing an embedded stud assembly.

Further, in a state where the embedded stud assembly is installed in the engagement groove, the embedded stud assembly extends from the body of the anti-slip structure toward the ground at a second height H2, for providing a second anti-slip force to enhance anti-slip capability.

Furthermore, in a state where the embedded stud assembly is installed in the engagement groove, the embedded stud assembly extends from the body of the anti-slip structure toward the ground at a height between the first height H1 and the second height H2, for providing adaptive second anti-slip force to enhance dynamic shock absorption capability.

Furthermore, the guide element comprises a first contact portion and a first connecting portion arranged at the bottom of the first contact portion, the first connecting portion having a first receiving groove formed therein.

The fixed base is arranged at the bottom of the guide element, comprising a seat body and a second receiving groove arranged in the seat body, the bottom of the second receiving groove being coaxially provided with a positioning groove, and the bottom surface of the seat body being provided with a through hole.

Wherein, the first connecting portion is movably arranged in the second receiving groove, the through hole and the positioning groove are axially communicated with each other, so that the fixed base forms a structure in which the upper and lower portions are in communication with each other, thereby improving the stability of anti-slip ground engagement.

Furthermore, the outer wall of the first connecting portion is provided with a first limiting ring, the inner wall of the second receiving groove is provided with a second limiting ring that is bulked and fitted with the outer wall of the first connecting portion, thereby facilitating installation and connection.

Furthermore, the diameter of the second receiving groove is greater than that of the positioning groove, and the diameter of the positioning groove is greater than that of the through hole, thereby improving structural stability.

Furthermore, the anti-slip portion comprises anti-slip studs, wherein an outer wall of the anti-slip stud is provided with a radially extending limiting flange adapted to the positioning groove.

Wherein the anti-slip stud is fixedly embedded within the positioning groove with one end penetrating through the through hole, and the other end extending into the first receiving groove and abutting against the top wall of the first receiving groove to prevent loosening.

Further, the anti-slip portion comprises an anti-slip stud, an outer wall of the anti-slip stud is provided with a radially extending limiting flange adapted to the positioning groove, the anti-slip portion further comprises a spring, with one end of the spring embedding within the first receiving groove, and the other end fitting on the anti-slip stud and abutting against the top surface of the limiting flange;

Wherein, the anti-slip stud is embedded within the positioning groove with one end penetrating through the through hole, and the other end retractably arranging in the second receiving groove via the spring, thereby enhancing the anti-slip force in contact with the ground.

Furthermore, the first contact portion is shaped as a hemisphere, thereby facilitating rapid guidance during installation.

Furthermore, the seat body is a multi-sided frustum structure with equal upper and lower portions, configuring to prevent horizontal rotational movement.

Furthermore, a portion of the first connecting portion is installed within the second receiving groove, with another portion exposed outside of the opening of the second receiving groove, and together with the bottom surface of the first contact portion and the top surface of the seat body forms an annular positioning groove, to prevent upward and downward disengagement and enhance stability.

Furthermore, the material of the anti-slip portion is selected from any one of steel, plastic, and carbon fiber, thereby enhancing applicability and reliability.

Furthermore, during the walking process, when the anti-slip structure contacts the ground, the spring of the embedded stud assembly undergoes adaptive elastic deformation in response to center of gravity changes during the walking process, thereby providing a height between the first height H1 and the second height H2, improving dynamic shock absorption capability.

Furthermore, the engagement groove is a multi-layer structure, with a positioning block adapted to the positioning groove provided between the upper and lower layers of the engagement groove, the positioning block dividing the engagement groove into an upper groove and a lower groove that are arranged one above other, wherein the shapes of the upper and lower layers are respectively adapted to the first connecting portion and the seat body, thereby improving stability during assembly.

Furthermore, when the embedded stud assembly is engaged into the engagement groove, its first contact portion is guided into the upper groove, wherein the positioning block and positioning groove engage with each other to restricting axial movement of the embedded stud assembly and prevent disengagement.

Furthermore, when the embedded stud assembly is engaged into the engagement groove, its seat body cooperatively engages into the lower groove, wherein the lower groove has a polygonal groove adapted to the seat body, forming geometric constraint on the stud assembly to improve stability and restrict horizontal rotational movement of the stud assembly, thereby enhancing anti-disengagement effect.

Furthermore, the bottom wall of the engagement groove protrudes upward, forming a spherical protrusion on the top surface of the body, for providing space to accommodate the embedded stud assembly, wherein the depth of the space related to the height of the embedded stud assembly, thereby enhancing shock-absorbing capability.

Furthermore, a prying groove is formed by extending outward from the inner wall on either side of the engagement groove to facilitate disassembly.

Furthermore, the anti-slip structure comprises an installation and removal auxiliary tool for installing and removing the embedded stud assembly, the installation and removal auxiliary tool comprising a prying portion and a gripping portion, wherein the gripping portion is provided with a positioning hole at its bottom for assisting installation, thereby facilitating installation.

Furthermore, the anti-slip units are distributed in fractal geometry on the forefoot and rearfoot of the body respectively, thereby dispersing plantar pressure to improve comfort.

Furthermore, the bottom of the body is further provided with a plurality of anti-slip treads for enhancing slip resistance and ground grip, thereby enhancing the anti-slip effect.

Furthermore, the anti-slip structure is prepared primarily with rare earth cis-polybutadiene rubber and nitrile rubber, for improving the tear strength, tensile strength and wear resistance of the anti-slip structure.

As another aspect of the present invention, there is provided a shoe sole, further comprising a midsole, wherein the midsole has a first surface for contacting an instep and a second surface for contacting the anti-slip structure.

Wherein the second surface contacts the anti-slip structure according to any one of the aforementioned items, for enhancing the anti-slip force of the shoe sole;

Wherein the second surface of the midsole has at least one recess adapted to the protrusion, thereby providing installation space.

Further, the recess is configured to provide space for accommodating the protrusion, wherein the depth of the space is positively correlated with the height of the protrusion that accommodates the embedded stud assembly, thereby improving component stability and preventing displacement.

Further, the body and the midsole are joined by one of adhesive bonding, thermal welding, or stitching, thereby enhancing the durability and manufacturing efficiency of the shoe.

Furthermore, the embedded stud assemblies are arranged within the anti-slip unit in the forefoot of the shoe sole in a fractal geometry arrangement centered on at least two embedded stud assemblies, and the embedded stud assemblies are arranged within the anti-slip unit in the rearfoot of the shoe sole in a fractal geometry arrangement centered on at least one embedded stud assembly, such that the force distribution on the sole of the foot is uniform.

Furthermore, the body, midsole and embedded stud assembly are manufactured using a layered processing method, which improves yield rate, reduces cost and facilitates processing.

As another aspect of the present invention, there is provided an application of an anti-slip structure, which comprises an application body and the anti-slip structure according to any one of the above, wherein the anti-slip structure is embedded and replaceably installed on the application body.

Furthermore, the application body comprises: a trekking pole body, an anti-slip glove body, an outdoor camping box body, a robot foot sole body, and a toy car tire body, providing additional grip for the aforementioned equipment to prevent slipping.

(III) Beneficial Effects

The beneficial effects of the present invention are: the embedded stud assembly of the present invention can adaptively adjust according to ground conditions, when confronting complex and diverse extreme outdoor terrains, such as exposed rock, icy and snowy road surfaces, slippery rock, muddy mountain paths, or frozen soil, the spring within the embedded stud assembly will undergo elastic deformation based on changes in center of gravity during the walking process. and can effectively absorb impact force through the cushioning action of the spring, thereby improving shock absorption performance, significantly enhancing walking comfort, effectively reducing foot fatigue caused by prolonged walking, the embedded stud assembly can rapidly respond as the center of gravity transitions forward and backward along the sole, maintaining reliable friction between the shoe sole and ground at all times, effectively preventing slipping and improving safety when walking on complex terrain.

When partial embedded stud assemblies become damaged, the present invention enables rapid disassembly and replacement adjustment. Under extreme environmental conditions, users can maintain excellent shoe sole performance without expending excessive physical effort on complex maintenance operations, thereby providing more reliable protection for users during outdoor exploration and specialized operations.

BRIEF DESCRIPTION OF THE DRAWINGS

Other features, objects and advantages of the present invention will become more apparent through reading the detailed description of non-limiting embodiments with reference to the following drawings.

Figure 1:
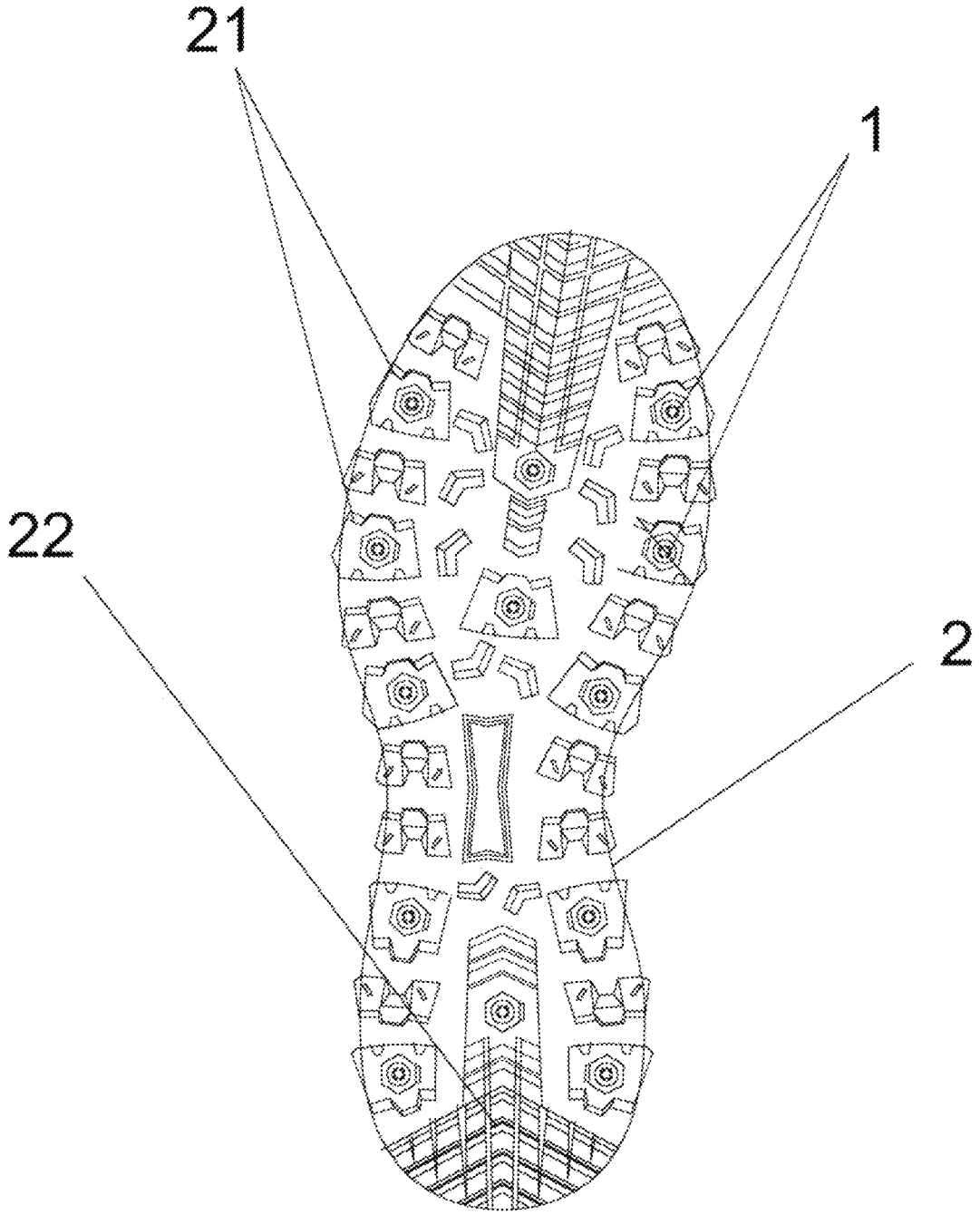
FIG. 1 is a structural schematic diagram of the anti-slip structure according to an embodiment of the present invention.

Description of main drawing reference numerals: 1, Embedded stud assembly; 11, Guide element; 111, First contact portion; 112, First connecting portion; 113, First receiving groove; 114, Positioning groove; 12, Fixed base; 121, Seat body; 122, Second receiving groove; 123, Positioning groove; 124, Through hole; 13, Anti-slip portion; 131, Anti-slip stud; 132, Spring; 133, Limiting flange; 2, Body; 21, Anti-slip unit; 211, Anti-slip block; 212, Engagement groove; 2121, Upper groove; 2122, Lower groove; 213, Protrusion; 214, Prying groove; 215, Positioning block; 22, Anti-slip tread; 3, Installation and removal auxiliary tool; 31, Prying portion; 32, Gripping portion; 33, Positioning hole; 4, Midsole; 411, Recess.

DETAILED DESCRIPTION

To facilitate clear understanding of the technical means, creative features, objectives and effects achieved by the present invention, the present invention is further elaborated below in conjunction with specific embodiments.

In the specific embodiments

Anti-slip Structure According to Embodiments of the Present Invention

Embodiment 1

FIG. 1 is a structural schematic diagram of the anti-slip structure according to an embodiment of the present invention. As shown in FIG. 1, the structure of the anti-slip structure according to the present invention will be described in detail.

Figure 2:
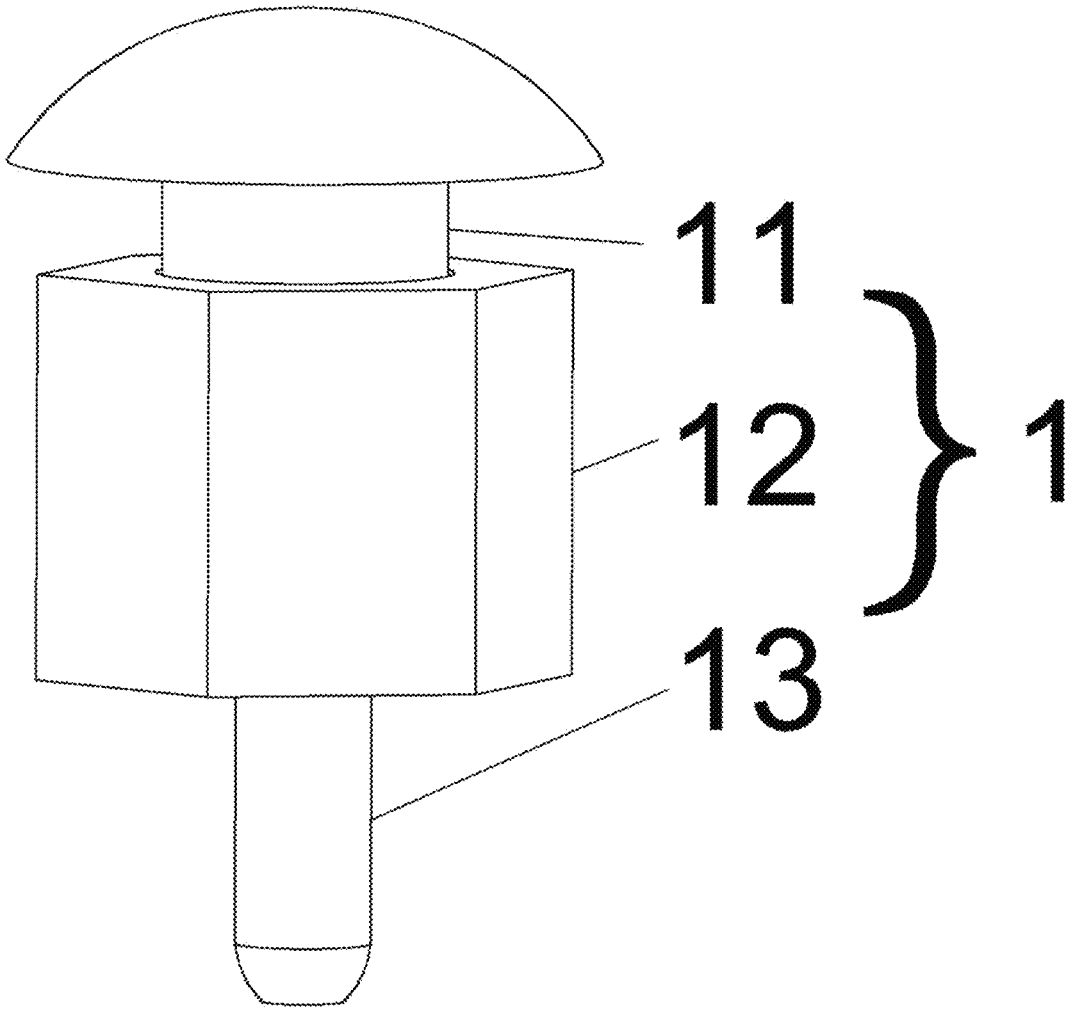
FIG. 2 is an overall structural schematic diagram of the embedded stud assembly according to an embodiment of the present invention.
Figure 3:
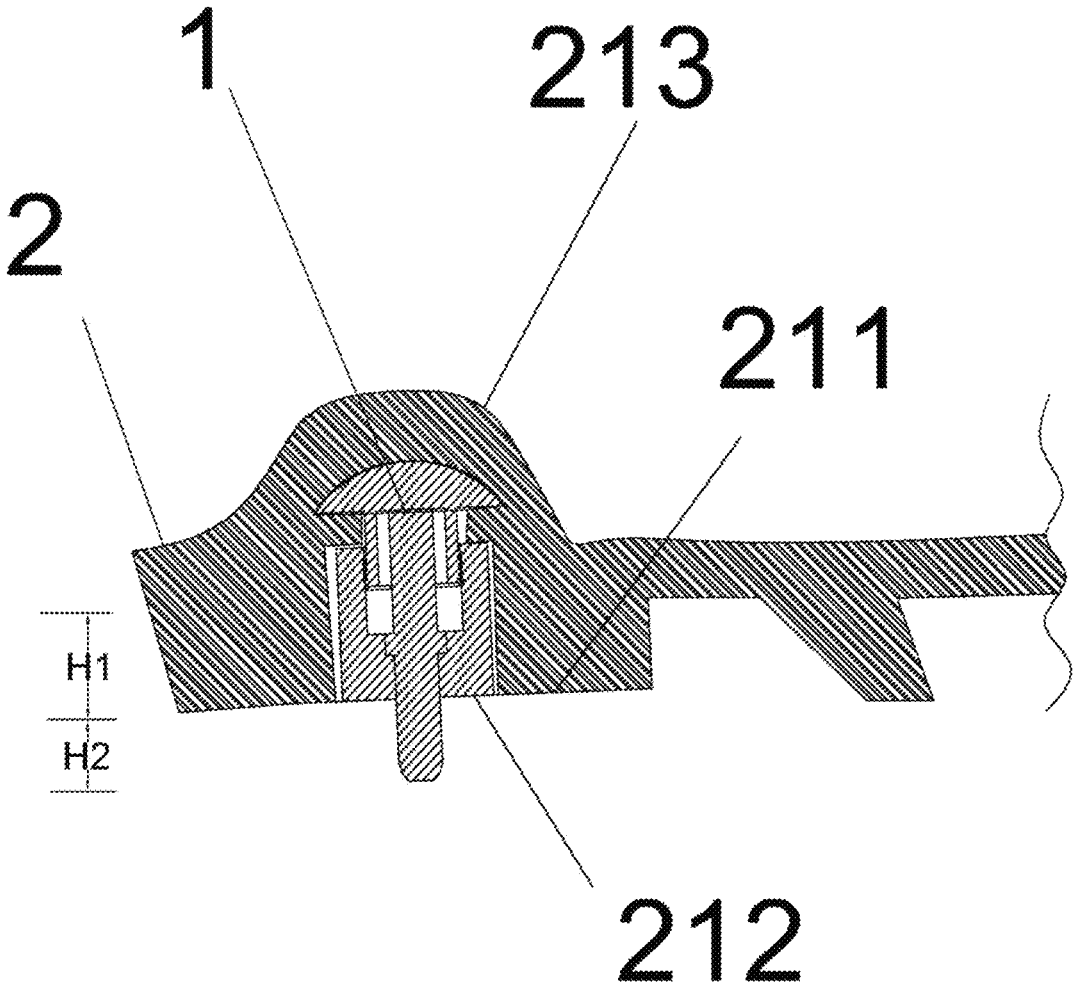
FIG. 3 is a partial sectional view of the anti-slip structure according to an embodiment of the present invention.

FIG. 2 is an overall structural schematic diagram of the embedded stud assembly according to an embodiment of the present invention, and FIG. 3 is a partial cross-sectional view of the anti-slip structure according to an embodiment of the present invention. As shown in FIGS. 2 and 3, the overall structure of the anti-slip structure according to embodiments of the present invention will be described in detail.

Describes an anti-slip structure according to an embodiment of the present invention, which comprises a body 2, wherein on the body 2 an embedded replaceable shock-absorbing anti-slip device for shock absorption and anti-slip function is detachably arranged, which comprises an embedded stud assembly 1, the embedded stud assembly 2 comprises a guide element 11 movably arranged up and down, a fixed base 12, and an anti-slip portion 13 arranged between the guide element 11 and the fixed base 12, the guide element 11 is configured to guide and engage the shock-absorbing anti-slip device, the fixed base 12 is configured to prevent detachment of the shock-absorbing anti-slip device, the anti-slip portion 13 is configured to prevent slipping and grip the ground when contacting the ground.

Wherein the body 2 comprises a first surface for contacting the ground and a second surface attached to the midsole of the shoe sole, wherein the embedded replaceable shock-absorbing anti-slip device is arranged on the first surface of the body 2.

Wherein the first surface comprises anti-slip units 21 extending from the body 2 of the anti-slip structure toward the ground at a first height H1 for providing first anti-slip force, when the foot contacts the ground, the anti-slip units 21 are capable of making initial contact with the ground, thereby increasing the contact area with the ground and closely conforming to the uneven structure of the ground, such that the friction force of the first surface of the anti-slip structure for contacting the ground is increased, thereby preventing slipping.

Wherein, at least one anti-slip unit 21 comprises an anti-slip block 211, the anti-slip block 211 having an engagement groove 212 formed therein for detachably installing the embedded stud assembly 1.

In order to improve anti-slip force, with the embedded stud assembly 1 installed in the engagement groove 212, the stud assembly 1 extends from the body 2 of the anti-slip structure toward the ground by a second height H2 for providing a second anti-slip force. When the foot contacts the ground, the stud assembly 1 makes initial contact with the ground, providing the second anti-slip force and increasing the contact depth with the ground. The stud assembly 1 can penetrate the ground layer (such as snow layer, mud, or ice surface) to directly contact the underlying ground layer, thereby providing stronger anti-slip force. Subsequently, the anti-slip unit 21 contacts the ground to provide the first anti-slip force, providing greater contact area with the ground. This dual anti-slip protection is suitable for contacting hard grounds in extreme environments (such as exposed rock or frozen ground), providing reliable anti-slip performance.

Figure 5:
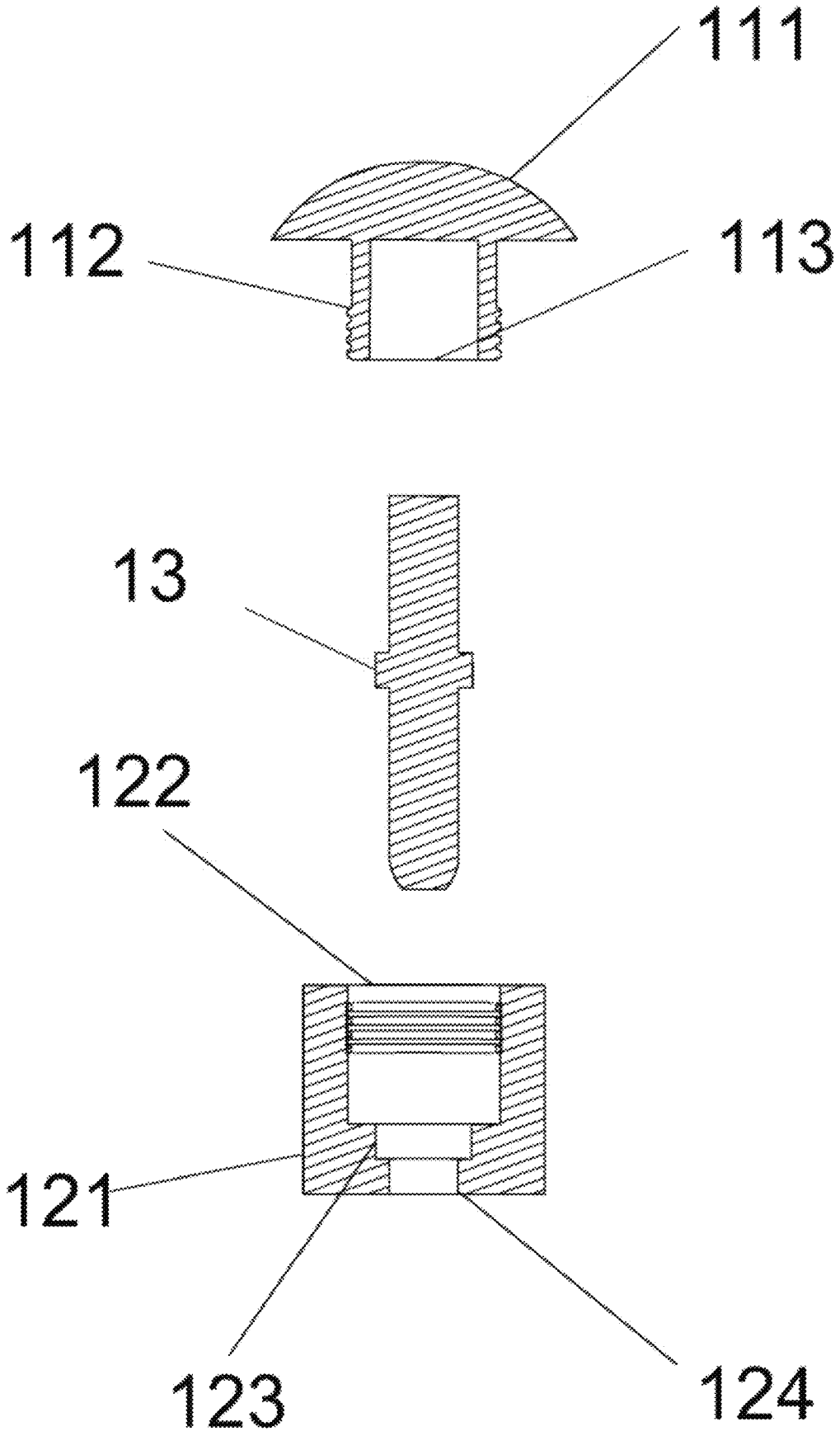
FIG. 5 is an exploded sectional view of the embedded stud assembly according to an embodiment of the present invention.

FIG. 5 is an exploded cross-sectional view of the embedded stud assembly according to the embodiment of the present invention. As shown in FIG. 5, the structure of the embedded stud assembly according to the embodiment of the present invention will be described in detail.

In order to improve the stability of anti-slip grip, the guide element 11 comprises a first contact portion 111 and a first connecting portion 112 arranged at the bottom of the first contact portion 111, wherein the first connecting portion 112 has a first receiving groove 113 formed therein, the fixed base 12 is arranged at the bottom of the guide element 11 and comprises a seat body 121 and a second receiving groove 122 arranged in the seat body 121, a positioning groove 123 is coaxially provided at the bottom of the second receiving groove 122, a through hole 124 is provided on the bottom surface of the seat body 121, wherein the first connecting portion 112 is movably arranged in the second receiving groove 122, and the through hole 124 and the positioning groove 123 are axially communication with each other, so that the fixed base 12 forms a structure in which the upper and lower portions are in communication with each other.

Figure 6:
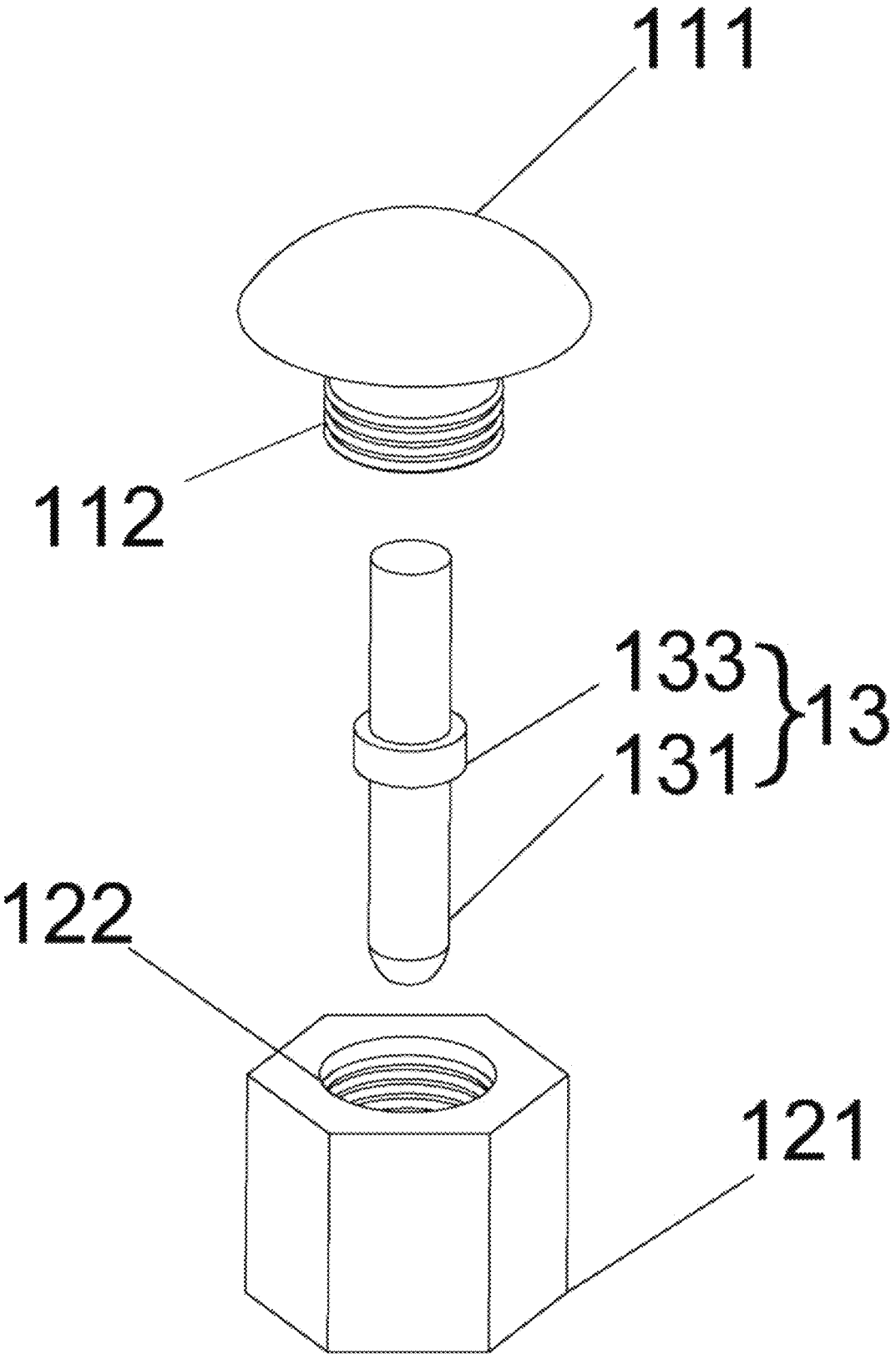
FIG. 6 is an exploded view of the embedded stud assembly according to an embodiment of the present invention.

FIG. 6 is an exploded view of the embedded stud assembly according to an embodiment of the present invention. As shown in FIG. 6, the connection method of the embedded stud assembly according to the present invention will be described in detail.

To improve stability, the outer wall of the first connecting portion 112 is provided with a first limiting ring, and the inner wall of the second receiving groove 122 is provided with a second limiting ring that is buckled and fitted with the outer wall of the first connecting portion 112. The threaded connection is stable and convenient, enabling rapid replacement and assembly/disassembly operations, thereby enhancing convenience.

Figure 7:
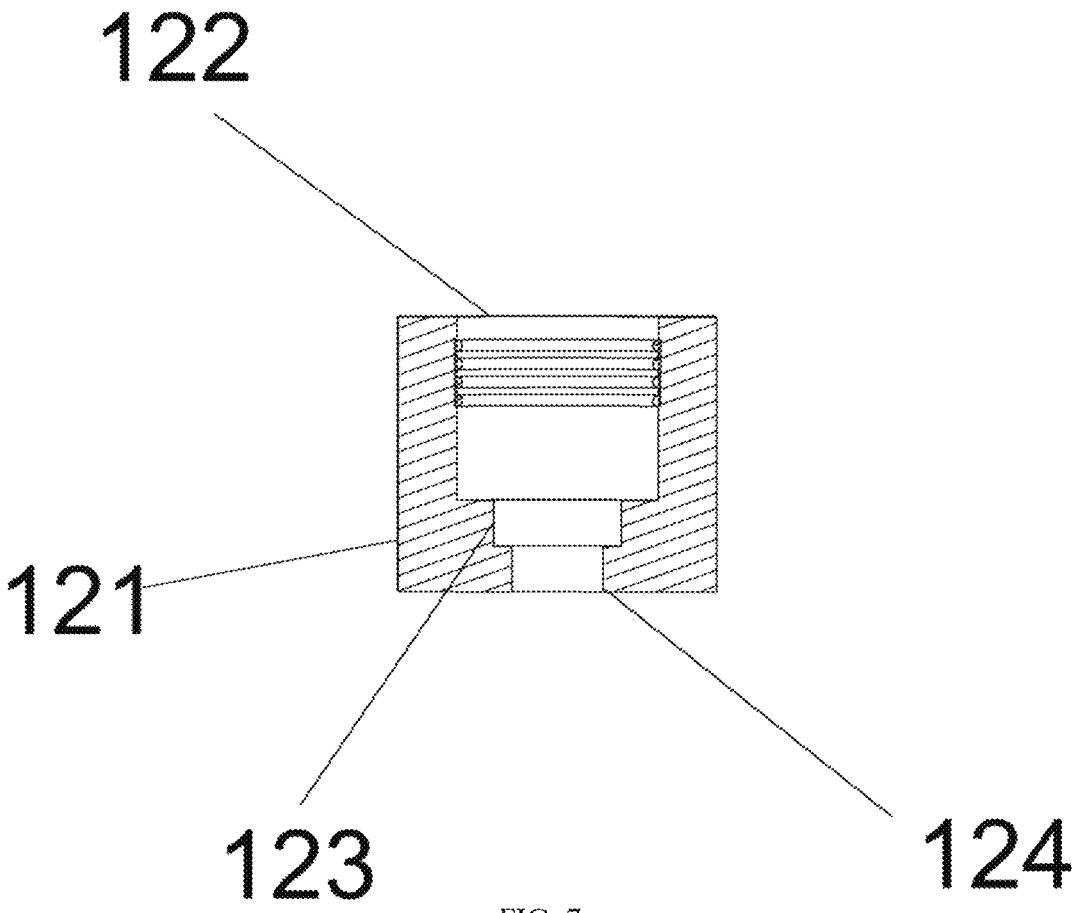
FIG. 7 is a cross-sectional view of the fixed base of the embedded stud assembly according to an embodiment of the present invention.

FIG. 7 is a cross-sectional view of the fixed base of the embedded stud assembly according to an embodiment of the present invention. As shown in FIG. 7, the structure of the seat body according to the embodiment of the present invention will be described in detail.

To engage the anti-slip portion 13, the second receiving groove 122 has a diameter larger than the positioning groove 123, and the positioning groove 123 has a diameter larger than the through hole 124. The positioning groove 123 is configured to fit with the anti-slip portion 13 to enhance its stability and prevent loosening.

Figure 8:
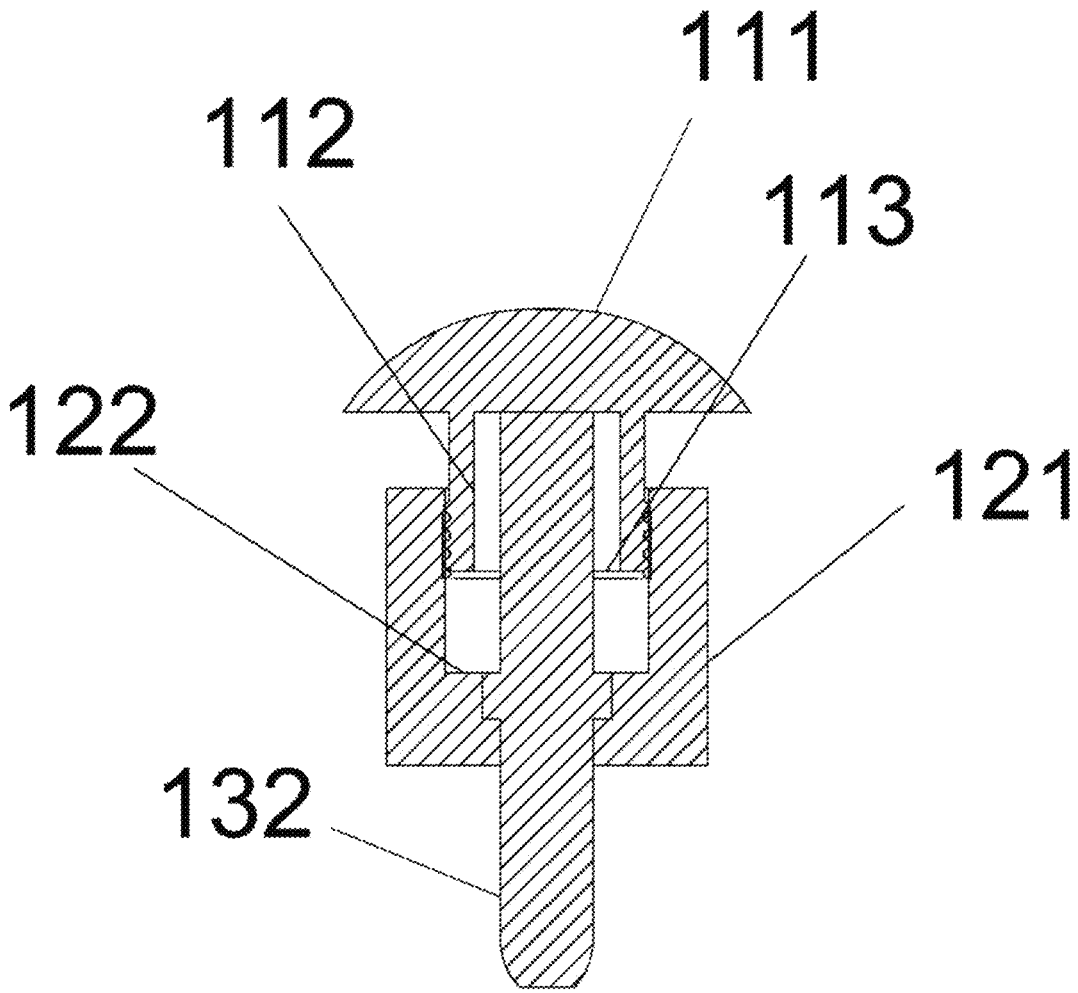
FIG. 8 is an assembled cross-sectional view of the embedded stud assembly according to an embodiment of the present invention.

FIG. 6 shows an exploded view of the embedded stud assembly according to an embodiment of the present invention, and FIG. 8 shows an assembled cross-sectional view of the embedded stud assembly according to an embodiment of the present invention. As shown in FIGS. 6 and 8, the assembled structure of the embedded stud assembly according to an embodiment of the present invention will be described in detail.

To improve stability, the anti-slip portion 13 comprises an anti-slip stud 131, wherein the outer wall of the anti-slip stud 131 is provided with a limiting flange 133 extending radially and adapted to the positioning groove 123. The anti-slip stud 131 is fixedly embedded within the positioning groove 123 with one end penetrating through the through hole 124 and the other end extending into the first receiving groove 113 and abutting against the top wall of the first receiving groove 113. By providing the limiting flange 133 on the outer wall of the anti-slip stud 131 and adapting it to the positioning groove 123, the anti-slip stud 131 can be firmly embedded within the positioning groove 123, avoiding displacement or loosening due to external forces during use, which not only enhances the overall stability of the anti-slip portion 13 but also effectively improves its service life.

FIG. 2 is a schematic diagram of the overall structure of the embedded stud assembly according to an embodiment of the present invention. As shown in FIG. 2, the overall structure of the embedded stud assembly according to the embodiment of the present invention will be described in detail.

To facilitate rapid assembly and positioning of the device, the first contact portion 111 is shaped as a hemisphere. The hemispherical arc configuration not only provides guiding functionality and facilitates clamping and assembly operations, but also reduces frictional resistance during the assembly process, ensuring precise alignment between components.

To prevent horizontal rotational movement, the seat body 121 is a multi-sided truncated pyramid structure with equal upper and lower portions for preventing horizontal rotational movement. The geometric characteristics of the multi-sided truncated pyramid provide geometric constraints in the horizontal direction, effectively limiting rotational or translational movement of components in the horizontal plane, thereby ensuring device reliability in dynamic environments.

Figure 10:
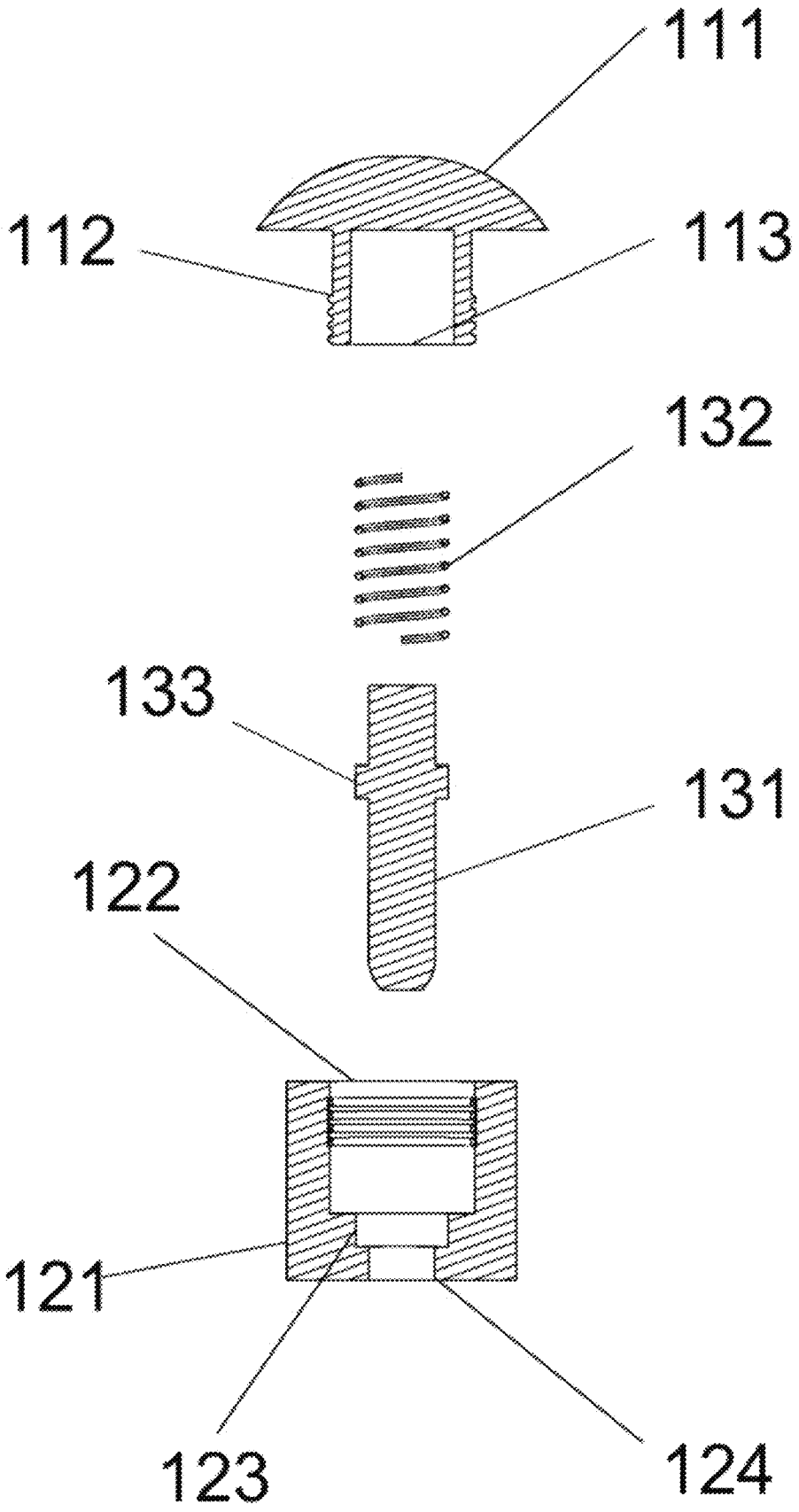
FIG. 10 is an exploded cross-sectional view of the embedded stud assembly according to another embodiment of the present invention.

FIG. 10 is a cross-sectional view of the embedded stud assembly according to an embodiment of the present invention. As shown in FIG. 10, the overall structure of the embedded stud assembly according to an embodiment of the present invention will be described in detail.

To prevent slippage, a portion of the first connecting portion 112 is installed in the second receiving groove 122, while another portion is exposed outside the opening of the second receiving groove 122, and together with the bottom surface of the first contact portion 111 and the top surface of the seat body 121 forms an annular positioning groove 114 for preventing upward and downward disengagement. The positioning groove 114 forms a recess in the radial direction to restrict axial movement thereof, preventing vibrational detachment during movement and improving stability.

To adapt to different scenario requirements, the material of the anti-slip portion 13 is selected from any one of steel, plastic, and carbon fiber, which can meet the needs of different application scenarios. By combining the advantages of various materials, the applicability and reliability of the device are enhanced, while also providing users with flexible selection options.

Figure 12:
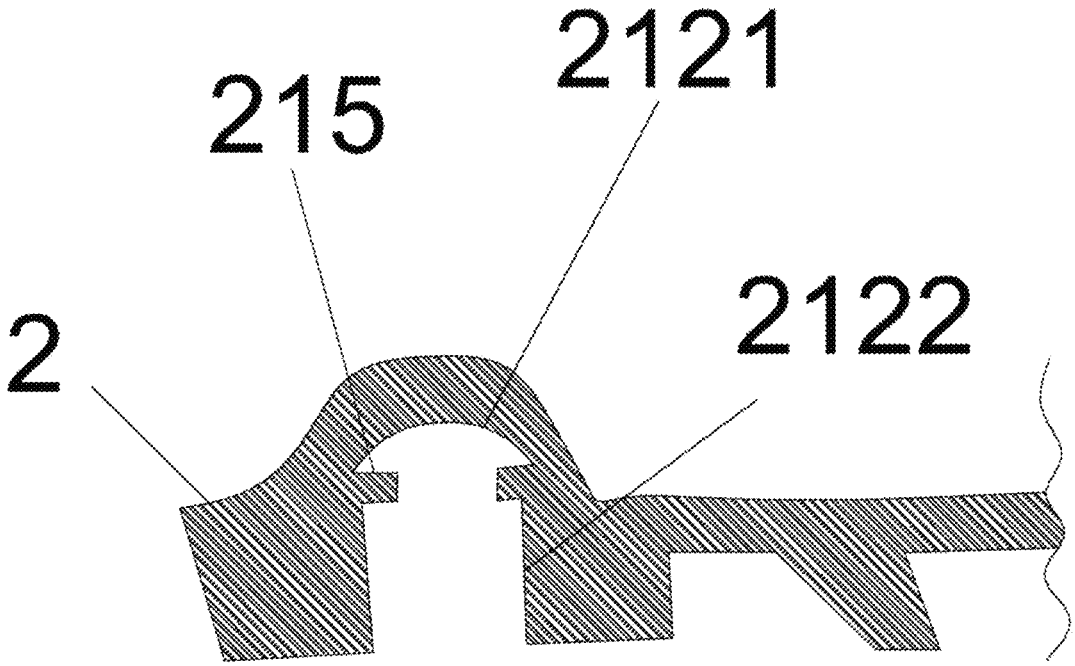
FIG. 12 is a cross-sectional view of the engagement groove according to an embodiment of the present invention.

FIG. 12 is a cross-sectional view of the engagement groove according to an embodiment of the present invention. As shown in FIG. 12, the overall structure of the engagement groove according to an embodiment of the present invention will be described in detail.

To improve the stability of the anti-slip structure, the engagement groove 212 is a multi-layer structure, wherein a positioning block 215 adapted to the positioning groove 114 is arranged between the upper and lower layers of the engagement groove 212. The positioning block 215 divides the engagement groove 212 into an upper groove 2121 and a lower groove 2122 that are arranged one above other, with the shapes of the upper and lower layers respectively adapted to the first connecting portion 112 and the seat body 121. This provides dual-layer fixed protection in both longitudinal and transverse directions, effectively improving stability during movement and preventing slippage. This enables the anti-slip structure to maintain good traction under various ground conditions, such as wet and slippery or oily surfaces, effectively preventing slipping and enhancing user safety and comfort. Meanwhile, in cases where the stud assembly 1 is damaged, it can be quickly removed from the engagement groove 212.

To improve axial stability, when the stud assembly 1 is engaged into the engagement groove 212, the first contact portion 111 thereof is guided into the upper groove 2121, wherein the positioning block 215 and the positioning groove 114 mutually engage with each other to restrict axial movement of the stud assembly 1, thereby preventing slippage during movement.

To improve horizontal stability, when the stud assembly 1 is engaged into the engagement groove 212, the seat body 121 thereof cooperatively fits into the lower groove 2122, wherein the lower groove 2122 is a polygonal groove adapted to the seat body 121, thereby forming geometric constraints on the stud assembly 1 to restrict horizontal rotational movement of the stud assembly 1 and enhance the anti-detachment effect.

FIG. 12 is a cross-sectional view of the engagement groove according to an embodiment of the present invention. As shown in FIG. 10, the protrusion structure of the anti-slip structure according to an embodiment of the present invention will be described in detail.

In order to provide a space for accommodating the stud assembly 1, the bottom wall of the engagement groove 212 protrudes upward, forming a spherical protrusion on the top surface of the body 2, which provides a space for accommodating the stub assembly 1, the depth of the space being related to the height of the stub assembly 1.

Figure 13:
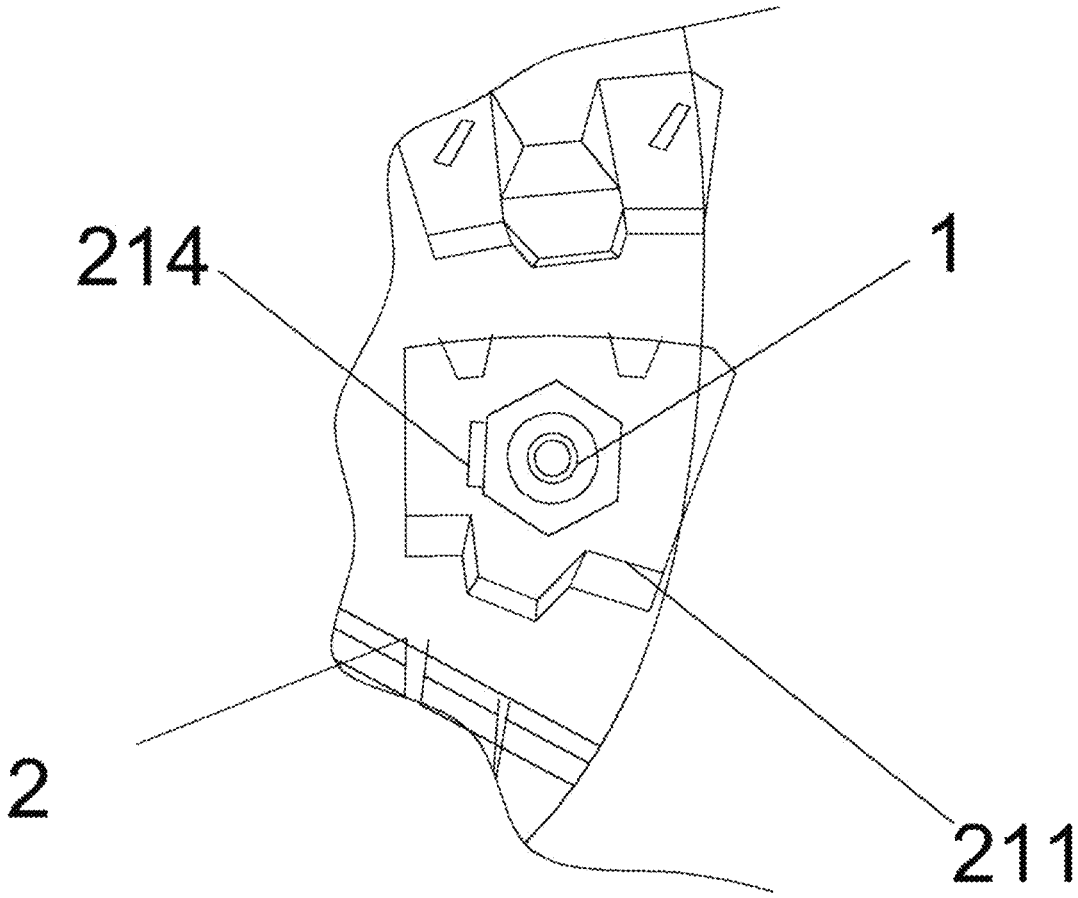
FIG. 13 is a partial enlarged view of the anti-slip structure according to an embodiment of the present invention.

FIG. 13 is a partial enlarged view of the anti-slip structure according to an embodiment of the present invention. As shown in FIG. 13, the structure of the prying groove of the anti-slip structure according to an embodiment of the present invention will be described in detail.

For convenient disassembly and replacement, a prying groove 214 is provided extending outward from the inner wall of any side of the engagement groove 212, wherein prying groove is used for quick disassembly and replacement of the stud assembly 1. When the stud assembly 1 is damaged, it can be quickly removed and replaced through the prying groove 214, thereby improving convenience.

Figure 14:
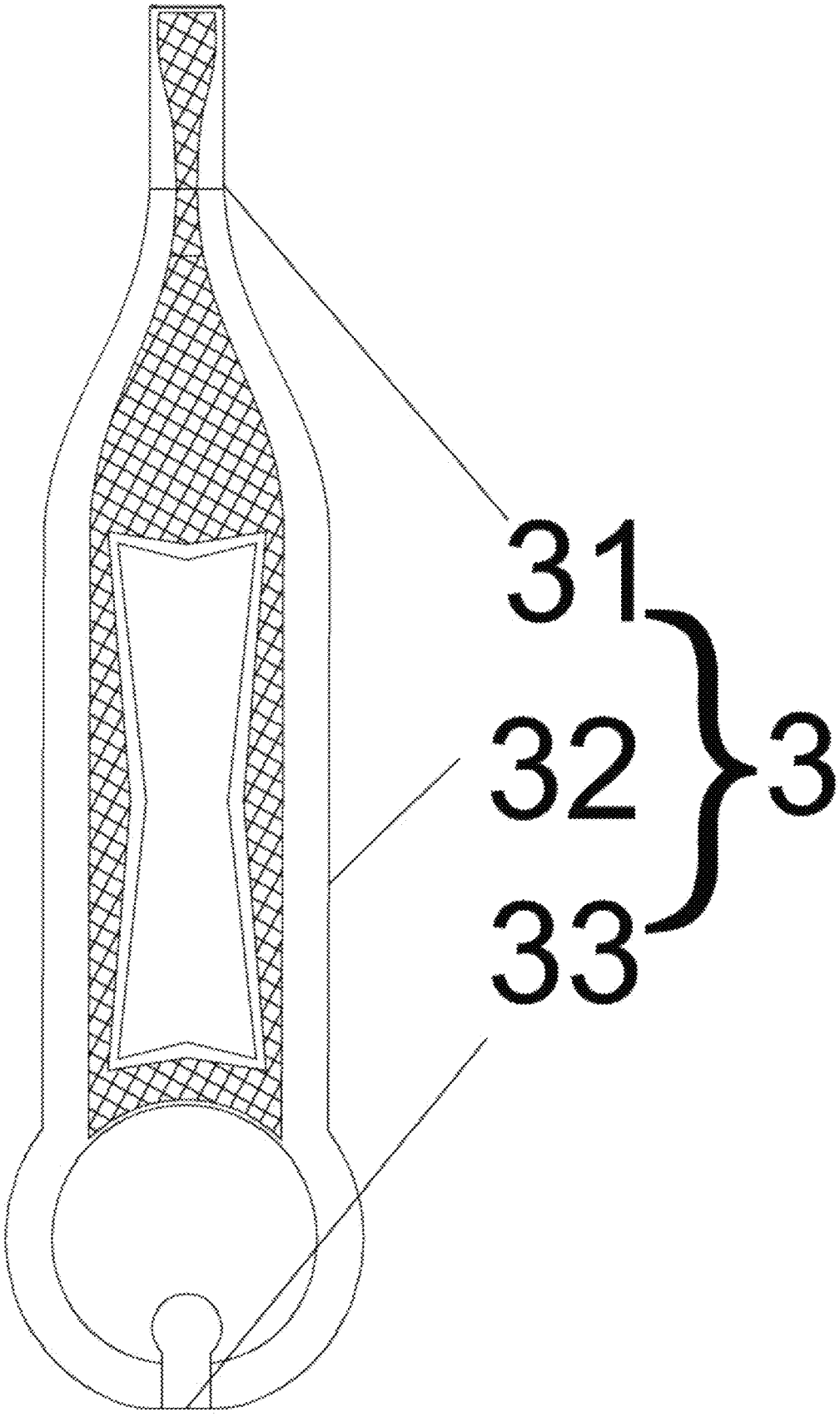
FIG. 14 is a structural schematic diagram of the installation and removal auxiliary tool according to an embodiment of the present invention.

FIG. 14 is a structural schematic diagram of the installation and removal auxiliary tool according to an embodiment of the present invention. As shown in FIG. 14, the structure of the installation and removal auxiliary tool according to an embodiment of the present invention will be described in detail.

For the convenience of disassembly and replacement, the anti-slip structure further comprises an installation and removal auxiliary tool 3 for installing and removing the embedded stud assembly 1, wherein the installation and removal auxiliary tool 3 comprises a prying portion 31 and a gripping portion 32, and the bottom of the gripping portion 32 is provided with a positioning hole 33 for auxiliary installation. During disassembly, grip the gripping portion 32 with hand, align the prying portion 31 with the prying groove 214, insert vertically into the groove, and then pull out vertically with force to disassemble the stud assembly 1. During installation, the stud assembly 1 can be directly picked up by hand, align one end of the guide element 11 with the engagement groove 212, and press vertically to complete installation. Alternatively, the auxiliary installation positioning hole 33 can be used by first embedding the portion of the anti-slip stud 131 at the bottom of the stud assembly 1 that protrudes from the through hole 124 into the positioning hole 33, then aligning with the engagement groove 212 and pressing vertically into it to complete replacement. Alternatively, first preliminarily engage and place the stud assembly 1 into the engagement groove 212, then align the positioning hole 33 of the installation and removal auxiliary tool 3 with the anti-slip stud 131 and press vertically, thereby providing multiple methods for disassembly and replacement, improving replacement convenience, and enabling rapid replacement in cases of component damage under extreme weather conditions.

FIG. 1 is a structural schematic diagram of the anti-slip structure according to an embodiment of the present invention. As shown in FIG. 1, the shock-absorbing anti-slip effect of the anti-slip structure according to the embodiment of the present invention will be described in detail.

In order to improve comfort and shock-absorbing effect, the anti-slip units 21 are respectively distributed in fractal geometry on the forefoot and rearfoot of the body 2, thereby dispersing plantar pressure to improve comfort. The anti-slip units 21 with fractal geometry distribution can ensure that the pressure in each area of the sole is uniformly distributed, thereby reducing situations of excessive local pressure and improving wearing comfort. At the same time, when the foot contacts the ground, they can fully absorb and disperse impact forces, enabling each anti-slip unit 21 to independently cushion impact forces, thereby reducing vibration received by the foot and providing better shock-absorbing effect.

To enhance the anti-slip effect, the bottom of the body 2 is further provided with a plurality of anti-slip treads 22 for enhancing anti-slip ground gripping, fully considering the usage requirements under different ground conditions, wherein the additionally provided anti-slip treads 22 further increase the contact area between the anti-slip structure and the ground.

To ensure stable engagement of the stud assembly with the anti-slip structure, the anti-slip structure is fabricated primarily from rare earth cis-polybutadiene rubber and nitrile rubber, wherein the rare earth cis-polybutadiene rubber exhibits extremely high elasticity and crystallization speed, excellent molecular chain flexibility, outstanding wear resistance performance and low wear volume, making it particularly suitable for high-frequency friction scenarios where the shoe sole is in long-term contact with the ground, while the nitrile rubber provides higher tear resistance strength and tensile strength, thereby enhancing the anti-damage capability of shoe sole edges and flexural regions and extending service life, characterized in that the two materials complement each other in performance such that the tear strength, tensile strength, elongation rate and wear resistance of the anti-slip structure are multiplied, wherein the performance parameters of the anti-slip structure are as follows:

Tear strength >8 kN/m

Tensile strength >180 kg/cm$^2$

Elongation rate >600%

Abrasion resistance DIN<90 mm$^3$.

Embodiment 2

For brevity of description, parts identical to those in Embodiment 1 will not be described redundantly. The following mainly describes structures different from Embodiment 1 of the present invention. The difference between Embodiment 2 and Embodiment 1 lies in the adaptive shock-absorbing configuration of the anti-slip structure.

Figure 4:
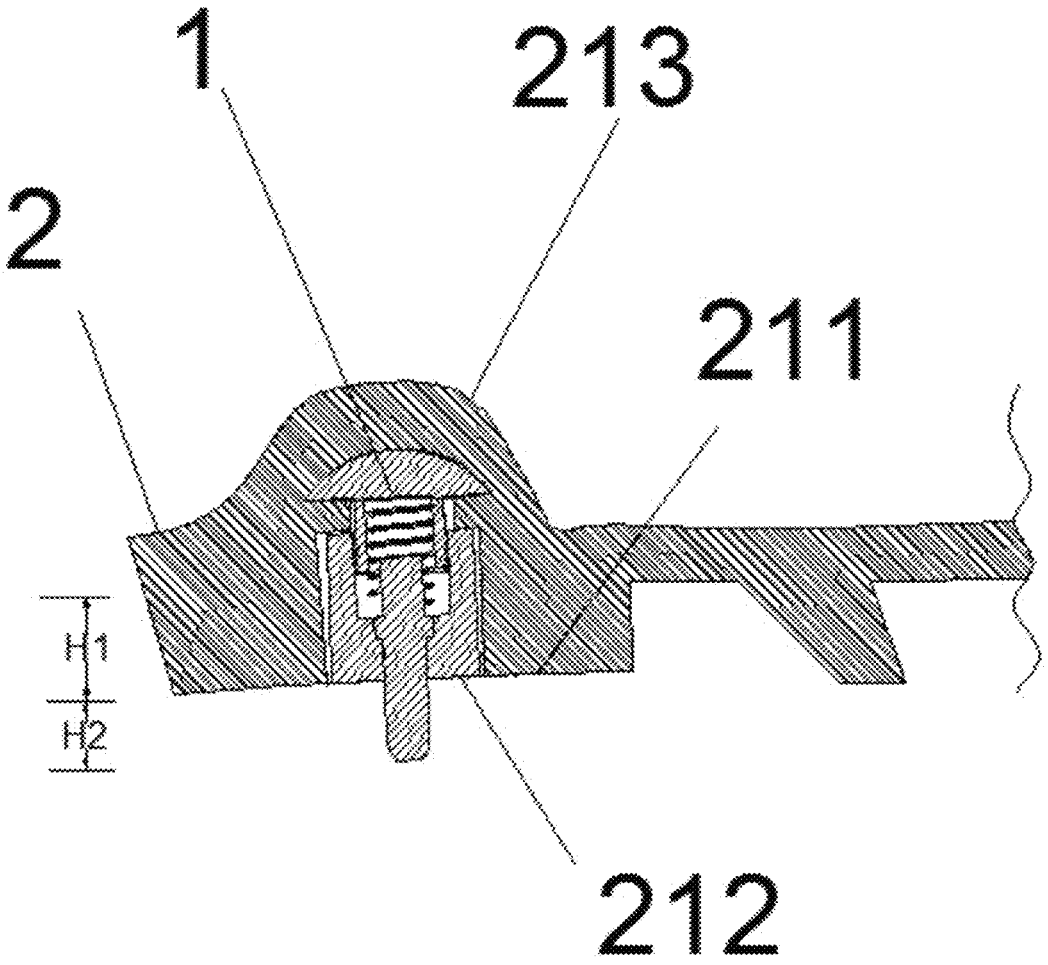
FIG. 4 is a partial sectional view of the anti-slip structure according to another embodiment of the present invention.

FIG. 4 is a partial sectional view of an anti-slip structure according to another embodiment of the present invention. As shown in FIG. 4, the shock-absorbing anti-slip effect according to another embodiment of the present invention will be described in detail.

Figure 11:
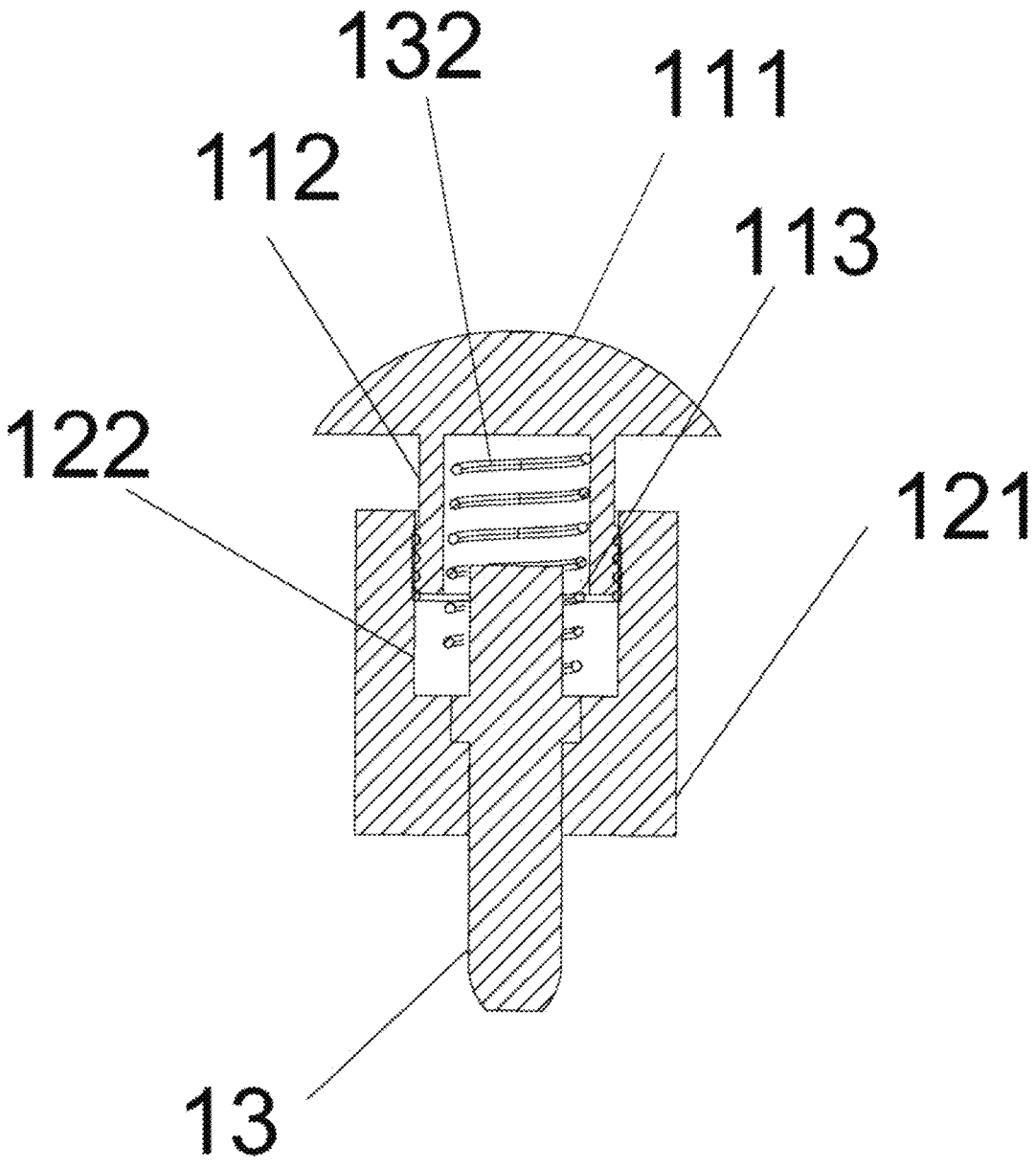
FIG. 11 is an assembled cross-sectional view of the embedded stud assembly according to another embodiment of the present invention.

FIG. 10 is an exploded cross-sectional view of an embedded stud assembly according to another embodiment of the present invention, and FIG. 11 is an assembled cross-sectional view of an embedded stud assembly according to another embodiment of the present invention. As shown in FIGS. 10 and 11, the assembled structure of the embedded stud assembly according to another embodiment of the present invention will be described in detail.

To enhance anti-slip force, the body 2 comprises a first surface for contacting the ground and a second surface attached to the midsole of the shoe sole, wherein the embedded replaceable shock-absorbing anti-slip device is arranged on the first surface of the body 2.

Wherein, in a state where the embedded stud assembly 1 is installed in the engagement groove 212, the stud assembly 1 extends from the body 2 of the anti-slip structure toward the ground at a height between the first height H1 and the second height H2, configured to provide adaptive second anti-slip force; when the foot contacts the ground, the stud assembly 1 makes contact with the ground first, providing the second anti-slip force; when the stud assembly 1 contacts various uneven ground layers (such as snow layers, dirt roads, rocky soil roads or ice surfaces), the retractable anti-slip portion 13 arranged inside the stud assembly 1 can adapt to the uneven conditions of different ground layers to provide stronger anti-slip force; subsequently, the anti-slip unit 21 contacts the ground to provide the first anti-slip force, providing greater contact area with the ground for dual anti-slip protection, suitable for contact with uneven grounds in extreme environments (such as snow layers, dirt roads, rocky soil roads), thereby providing reliable anti-slip effect.

In order to adapt to the uneven conditions of various terrains, the anti-slip portion 13 comprises an anti-slip stud 131, wherein an outer wall of the anti-slip stud 131 is provided with a radially extending limiting flange 133 adapted to the positioning groove 123, the anti-slip portion 13 further comprises a spring 132, wherein one end of the spring 132 is embedded within the first receiving groove 113 and the other end is mounted on the anti-slip studs 131 and abuts against the top surface of the limiting flange 133, the anti-slip stud 131 is embedded within the positioning groove 123 with one end penetrating through the through hole 124 and the other end telescopically disposed within the second receiving groove 122 via the spring 132, whereby through elastic deformation of the spring 132, adaptive feedback of the anti-slip stud 131 to different terrain variations and rise and fall movements of the foot's center of gravity is achieved.

For adaptive shock absorption, during the walking process, when the anti-slip structure contacts the ground, the spring 132 of the stud assembly 1 undergoes adaptive elastic deformation in response to center of gravity changes during the walking process, providing a height between the first height H1 and the second height H2. When walking on surfaces such as snow layers, dirt roads, or rocky soil roads, the sole center of gravity initially concentrates at the rearfoot position, whereupon the stud assembly 1 located at the rearfoot first contacts the ground. Due to the applied pressure, the anti-slip stud 131 undergoes elastic deformation through the spring 132 and retracts into the second receiving groove 122. When the sole center of gravity transitions to the forefoot, the stud assembly 1 of the forefoot responds to the pressure, causing the anti-slip stud 131 to undergo elastic deformation through the spring 132 and retract into the second receiving groove 122.

During this process, due to different uneven conditions of the ground, for any stud assembly 1 where the anti-slip stud 131 encounters a relatively protruding ground condition, its spring 132 experiences relatively large elastic deformation, and the spring 132 retraction amount is also relatively large, thereby providing a height H3 between the first height H1 and the second height H2; For another arbitrary stud assembly 1 where the anti-slip stud 131 encounters a relatively recessed ground condition, its spring 132 experiences relatively small elastic deformation, and the spring 132 retraction amount is also relatively small, thereby providing a height H4 between the first height H1 and the second height H2. At this time, the adaptive condition of any two stud assemblies 1 on the shoe sole relative to the ground is manifested as heights H3 and H4 between the first height H1 and the second height H2 (where H4 is greater than H3), thereby completing adaptation to different uneven ground conditions (when walking on any different uneven grounds, any stud assembly 1 will adapt to the ground through the spring 132 and provide a height Hn between the first height H1 and the second height H2, where Hn satisfies $H1 \leq Hn < H1+H2$);

According to different walking states (such as rearfoot-first ground contact or forefoot-first ground contact), the shock-absorbing effect is dynamically adjusted to reduce direct transmission of impact forces to the foot. The spring 132 continuously undergoes elastic deformation in response to center of gravity changes, effectively buffering the impact forces from the ground against the sole during walking, thereby greatly reducing the burden on joints such as knees and ankles during the walking process. In complex terrain such as snow layers, dirt roads, and rocky soil paths, the system similarly adjusts in real-time according to center of gravity changes to prevent slipping, thereby improving walking comfort and stability. Whether during starting, acceleration, deceleration, or turning in motion processes, reliable anti-slip protection is provided.

Shoe Sole According to Embodiment of the Present Invention

Embodiment 1

Figure 15:
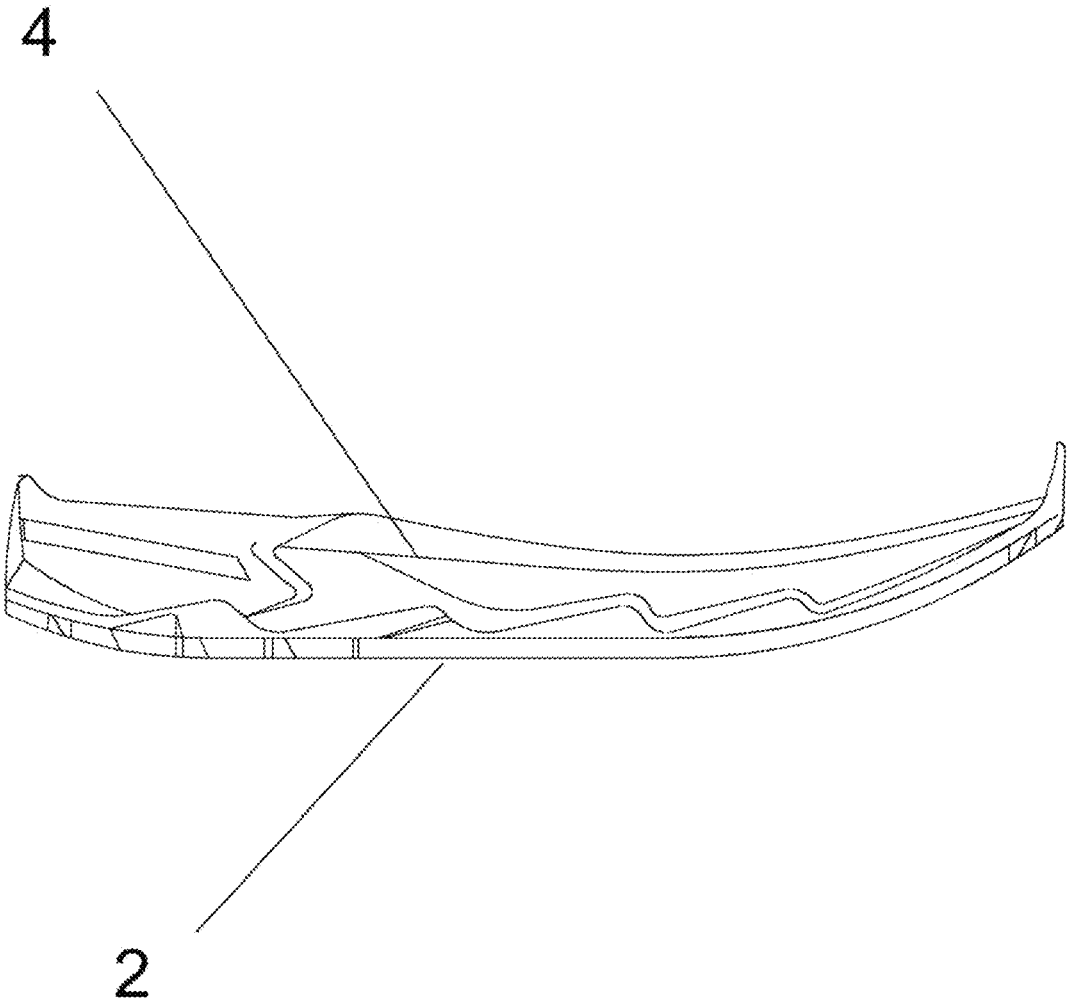
FIG. 15 is a side view of the shoe sole according to an embodiment of the present invention.
Figure 16:
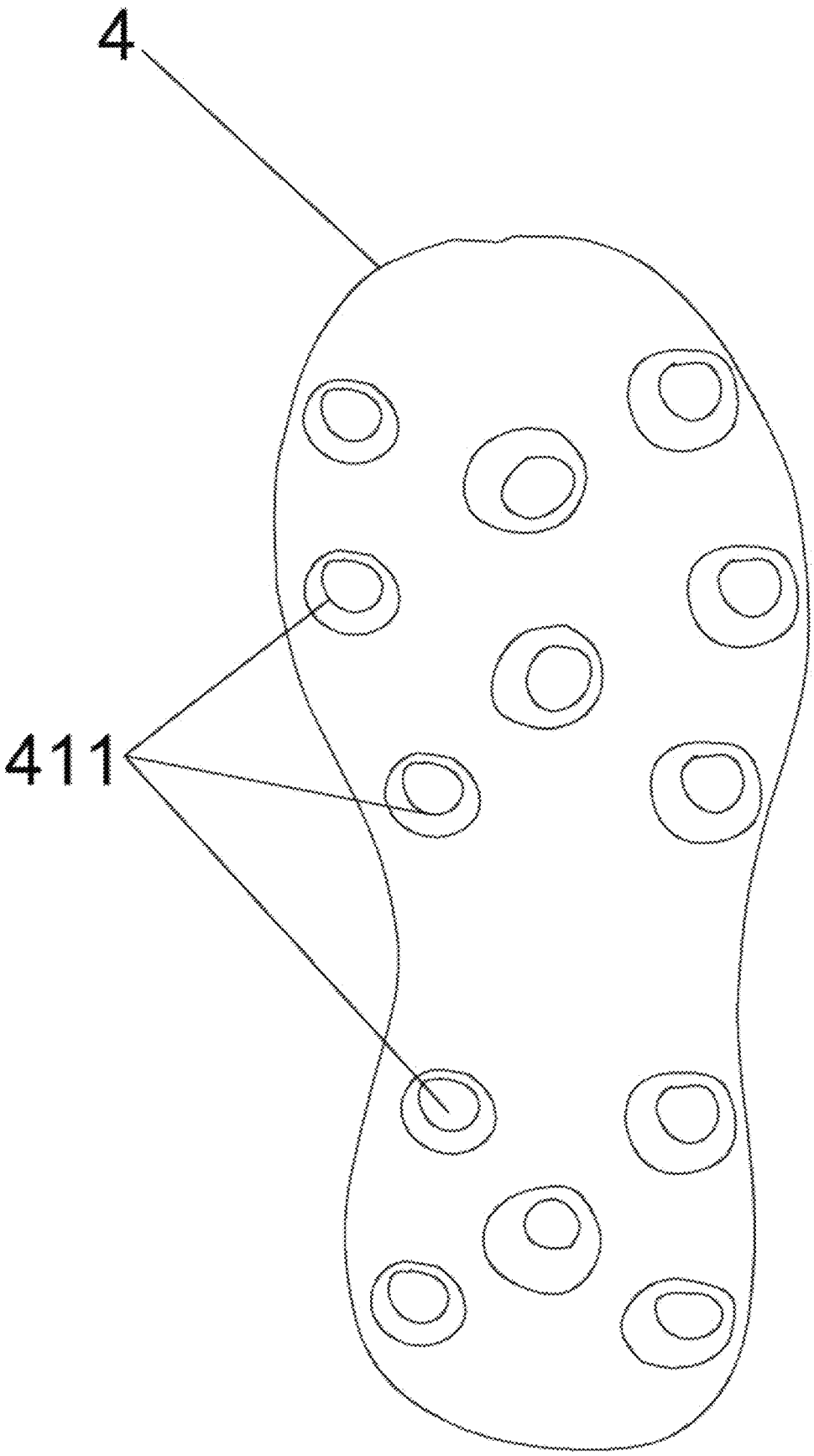
FIG. 16 is a top view of the midsole according to an embodiment of the present invention.

FIG. 15 is a side view of a shoe sole according to an embodiment of the present invention. FIG. 16 is a top view of a midsole according to an embodiment of the present invention. As shown in FIGS. 15 and 16, the midsole structure according to an embodiment of the present invention will be described in detail.

As another aspect of the present invention, there is provided a shoe sole further comprising a midsole 4, the midsole 4 having a first surface for contacting the instep and a second surface for contacting the anti-slip structure, wherein the second surface contacts the anti-slip structure according to any one of the aforementioned embodiments, wherein the second surface of the midsole 4 has at least one recess 411 adapted to the protrusion 213 for accommodating the protrusion 213.

Figure 17:
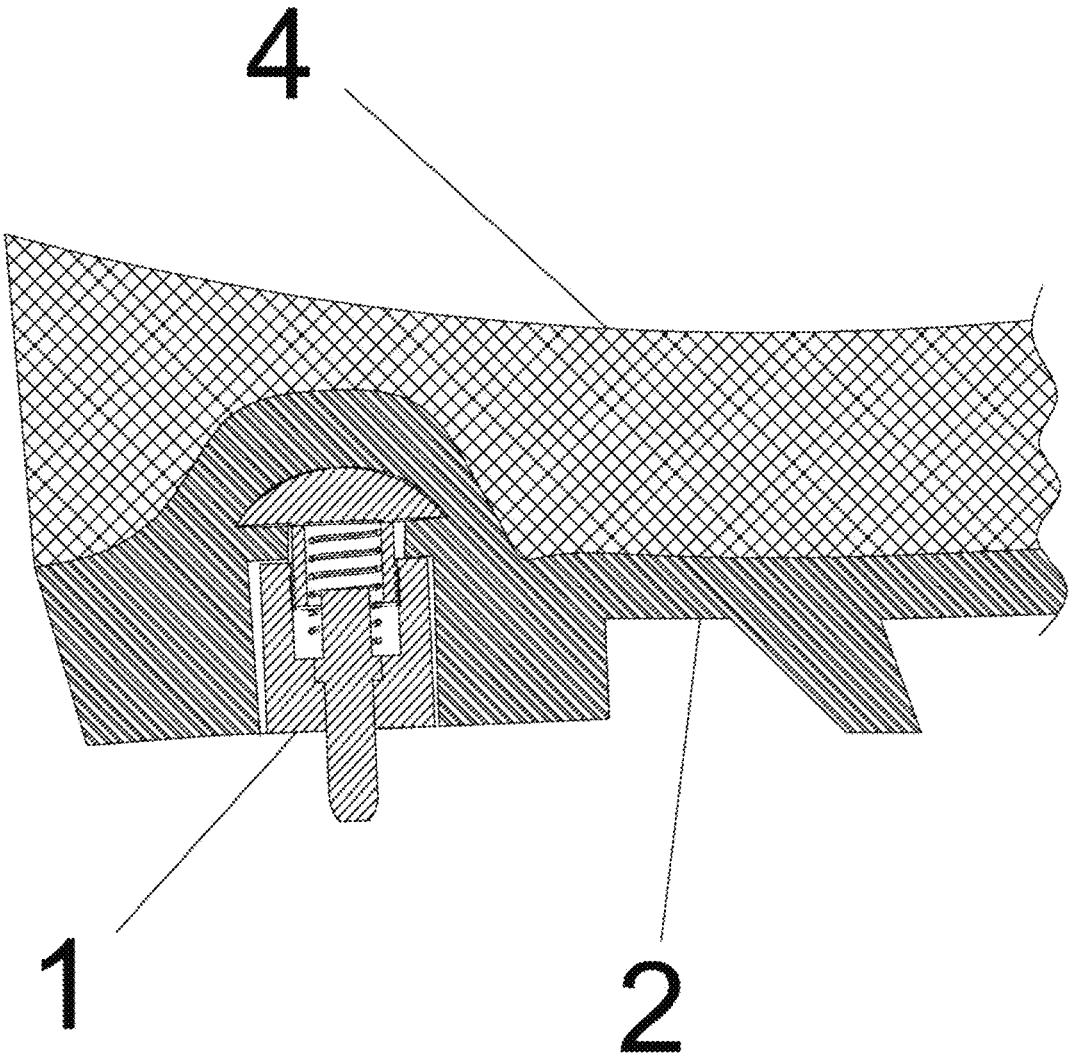
FIG. 17 is a side view of the midsole according to an embodiment of the present invention.

FIG. 17 is a top view of the midsole according to an embodiment of the present invention. As shown in FIG. 17, the recess structure according to the embodiment of the present invention will be described in detail.

In order to provide sufficient space, the recess 411 is configured to provide space for accommodating the protrusion 213, wherein the depth of the space is positively correlated with the height of the protrusion 213 that accommodates the stud assembly 1. When the embedded stud assembly 1 has a greater height, the protrusion 213 extends to a correspondingly greater height, and the depth of the recess 411 increases accordingly. Simultaneously, the engagement between the recess 411 and the protrusion 213 increases the friction force of the contact surface, ensuring that the protrusion 213 is firmly embedded within the recess 411, thereby forming greater frictional resistance between the contact surfaces to prevent sliding.

To improve the durability of the shoe sole, the body 2 and the midsole 4 are connected using one of adhesive bonding, hot melting, or stitching, which ensures the bonding strength and stability between the body 2 and the midsole 4, while enhancing the durability of the shoe and production efficiency.

Figure 9:
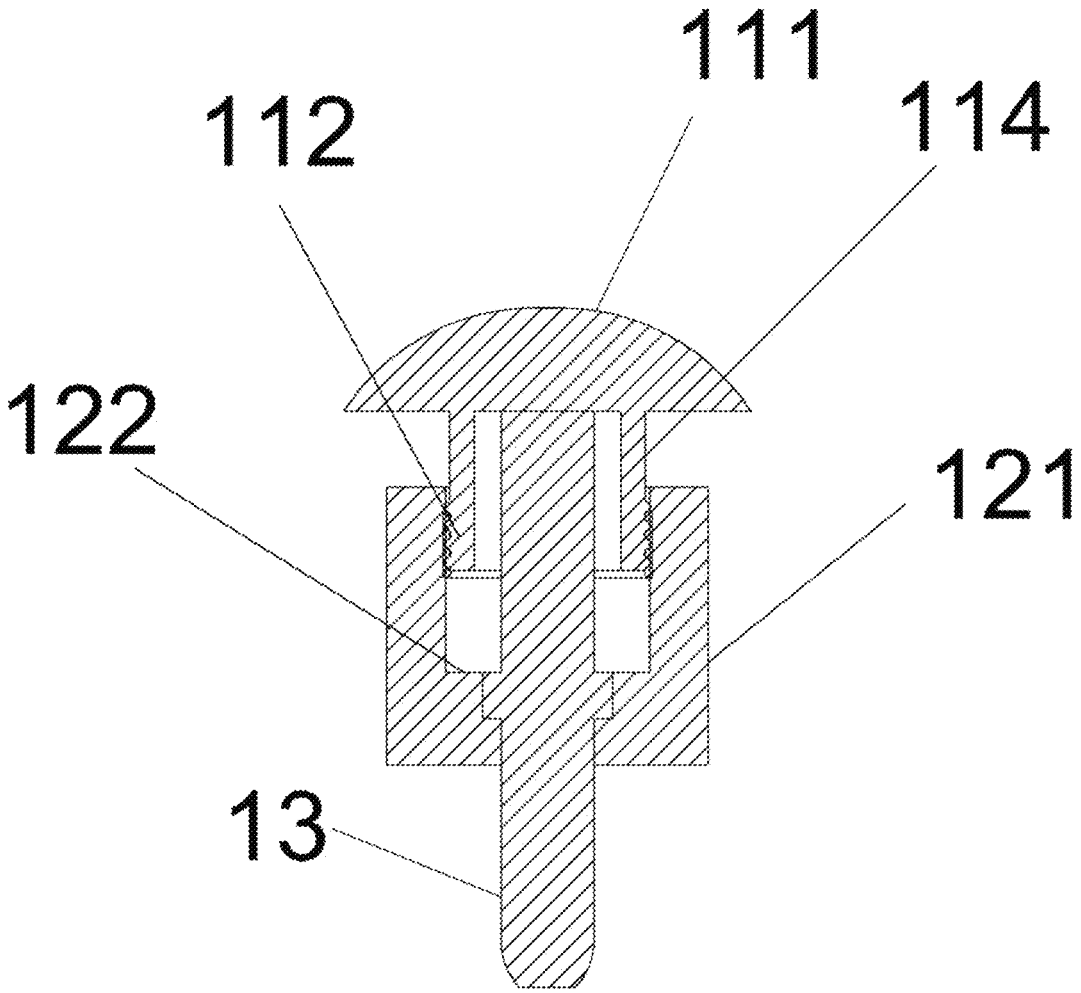
FIG. 9 is a cross-sectional view of the embedded stud assembly according to an embodiment of the present invention.

FIG. 9 is a structural schematic diagram of the anti-slip structure according to an embodiment of the present invention. As shown in FIG. 9, the overall structure of the anti-slip structure according to an embodiment of the present invention will be described in detail.

To ensure uniform force distribution across the shoe sole, the embedded stud assembly 1 is arranged in the anti-slip unit 21 in the forefoot region of the shoe sole using a fractal geometry arrangement centered on at least two stud assemblies 1, to provide the driving force required for greater grip in the forefoot area during movement (such as walking on muddy roads, mountain climbing, or walking on ice), and the embedded stud assembly 1 is arranged in the anti-slip unit 21 in the rearfoot region of the shoe sole using a fractal geometry arrangement centered on at least one stud assembly 1, to provide the stability required in the heel area during movement (such as walking on muddy roads, mountain climbing, or walking on ice), to disperse impact forces while conforming to the force distribution characteristics of human body movement, enabling the shoe sole to maintain good grip and stability in various movement scenarios.

To improve production efficiency, the body 2, midsole 4 and stud assembly 1 employ a layered processing method, wherein the body 2 and midsole 4 are processed first, followed by processing and assembly of the stud assembly 1 with the body 2, thereby enabling convenient and efficient manufacturing wherein each component can be individually processed with high precision, avoiding losses caused by integral processing, thus significantly improving product yield, reducing material waste, and achieving production cost reduction.

Figure 18:
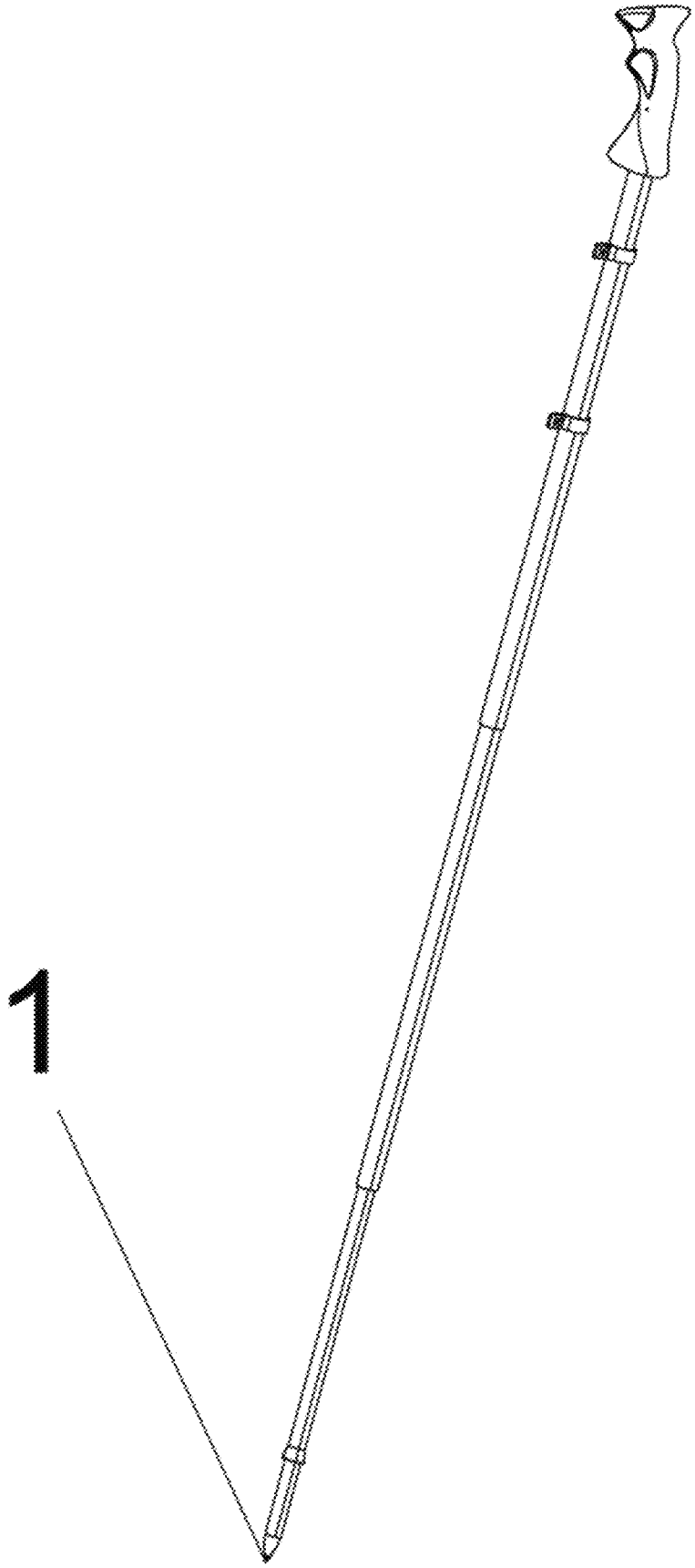
FIG. 18 is a structural schematic diagram of the anti-slip structure applied to a trekking pole according to an embodiment of the present invention.
Figure 19:
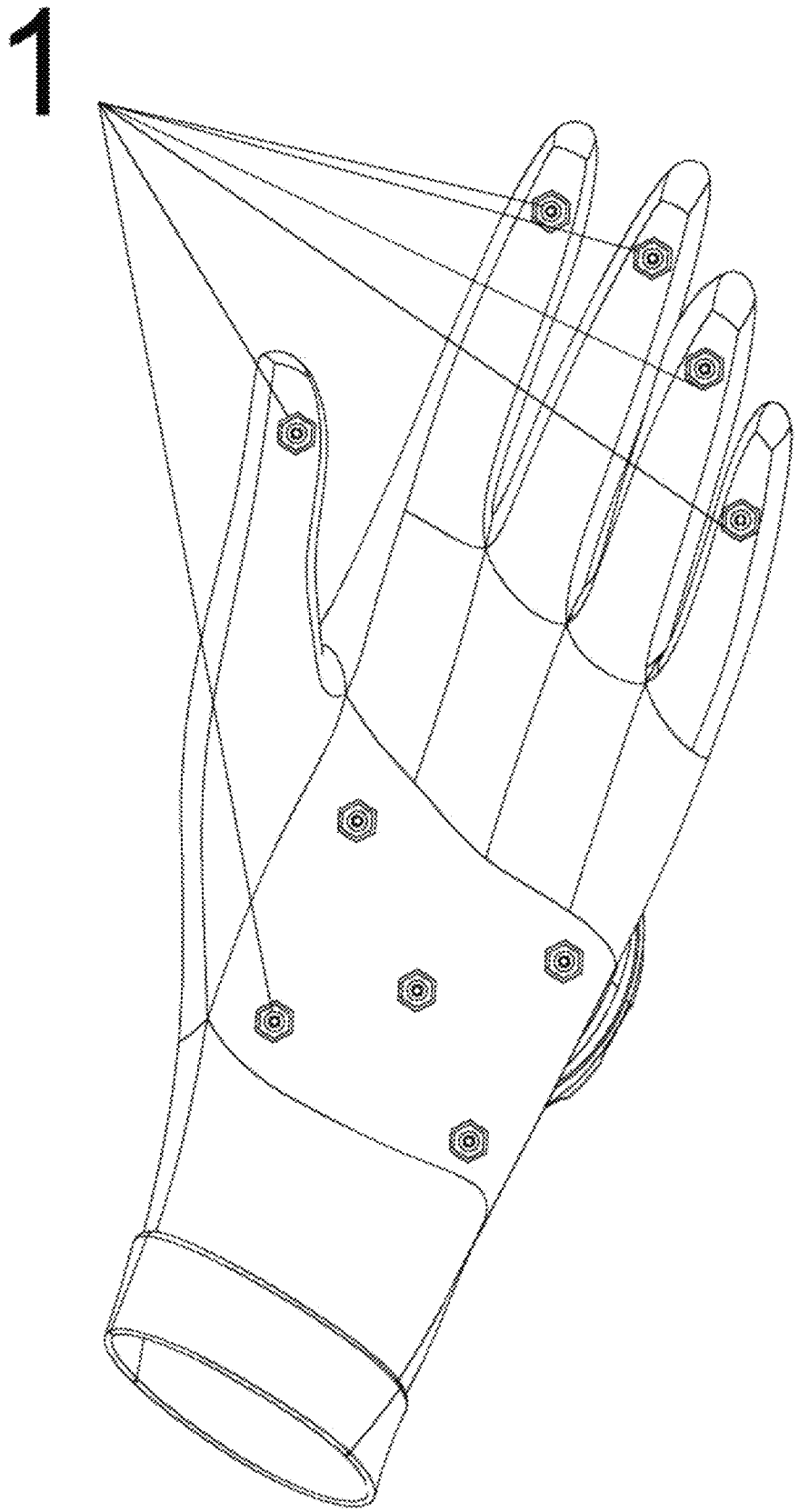
FIG. 19 is a structural schematic diagram of the anti-slip structure applied to an anti-slip glove according to an embodiment of the present invention.
Figure 20:
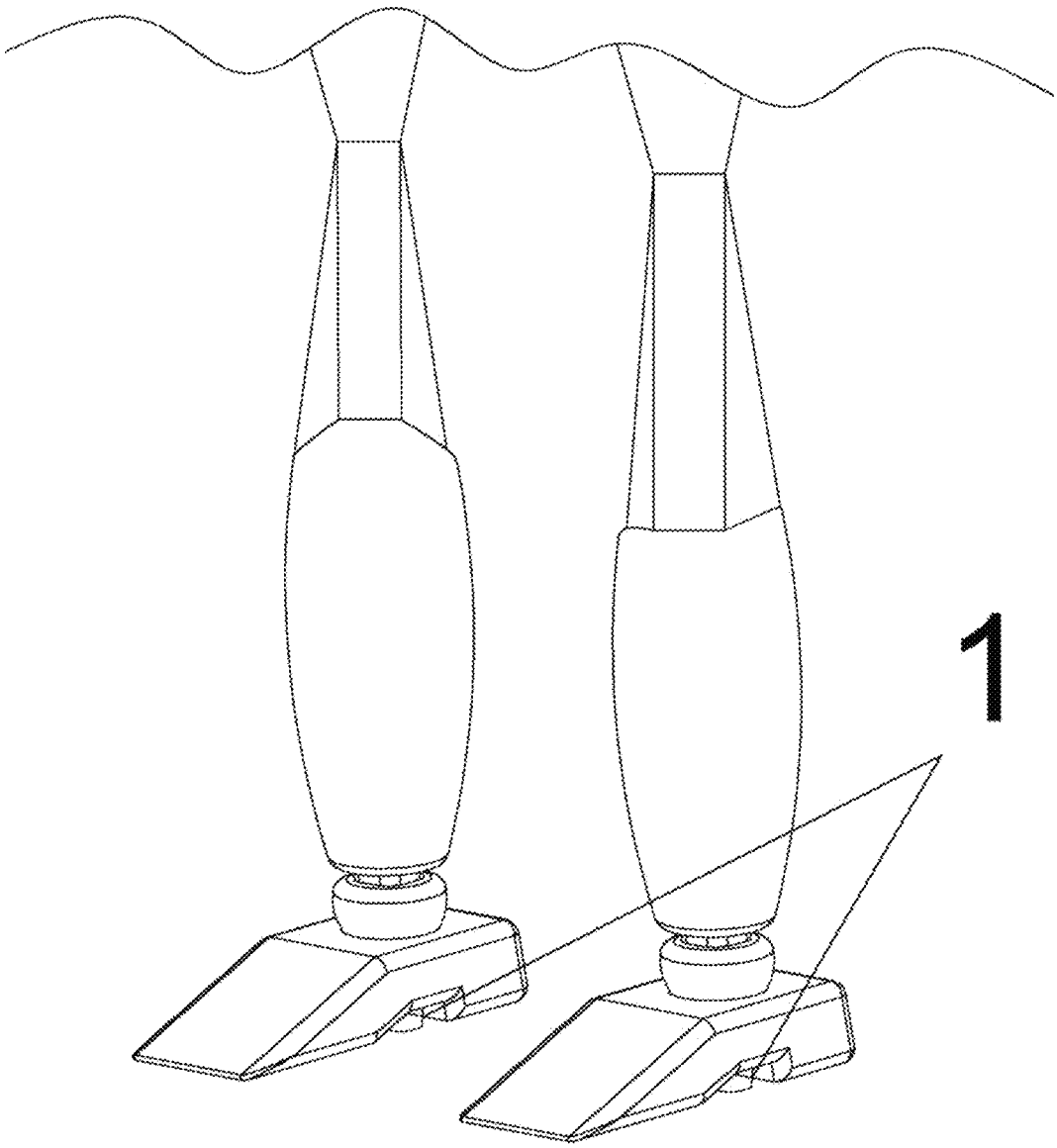
FIG. 20 is a partial schematic diagram of the anti-slip structure applied to a robot foot sole according to an embodiment of the present invention.
Figure 21:
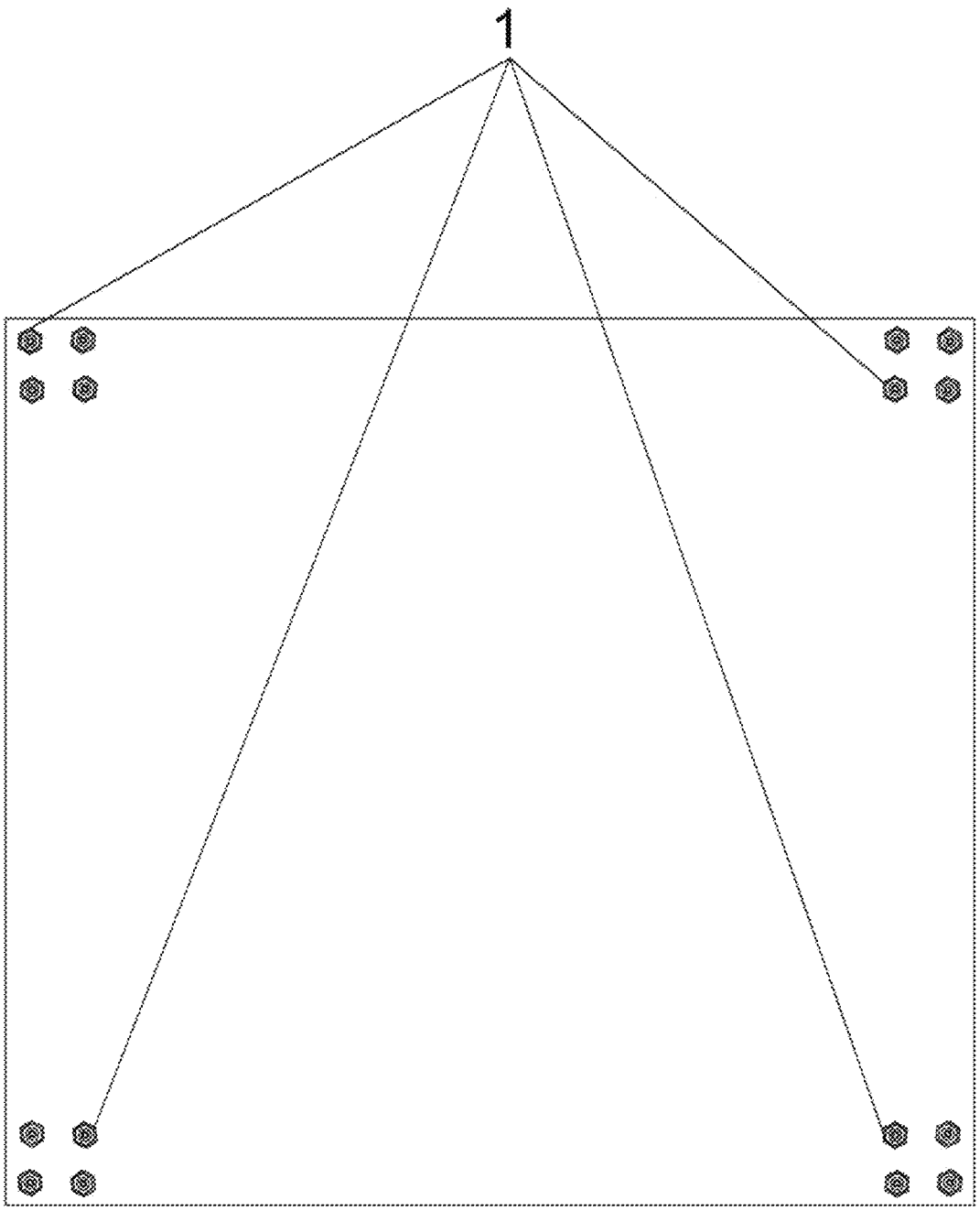
FIG. 21 is a bottom view of the anti-slip structure applied to the bottom of an outdoor camping box according to an embodiment of the present invention.
Figure 22:
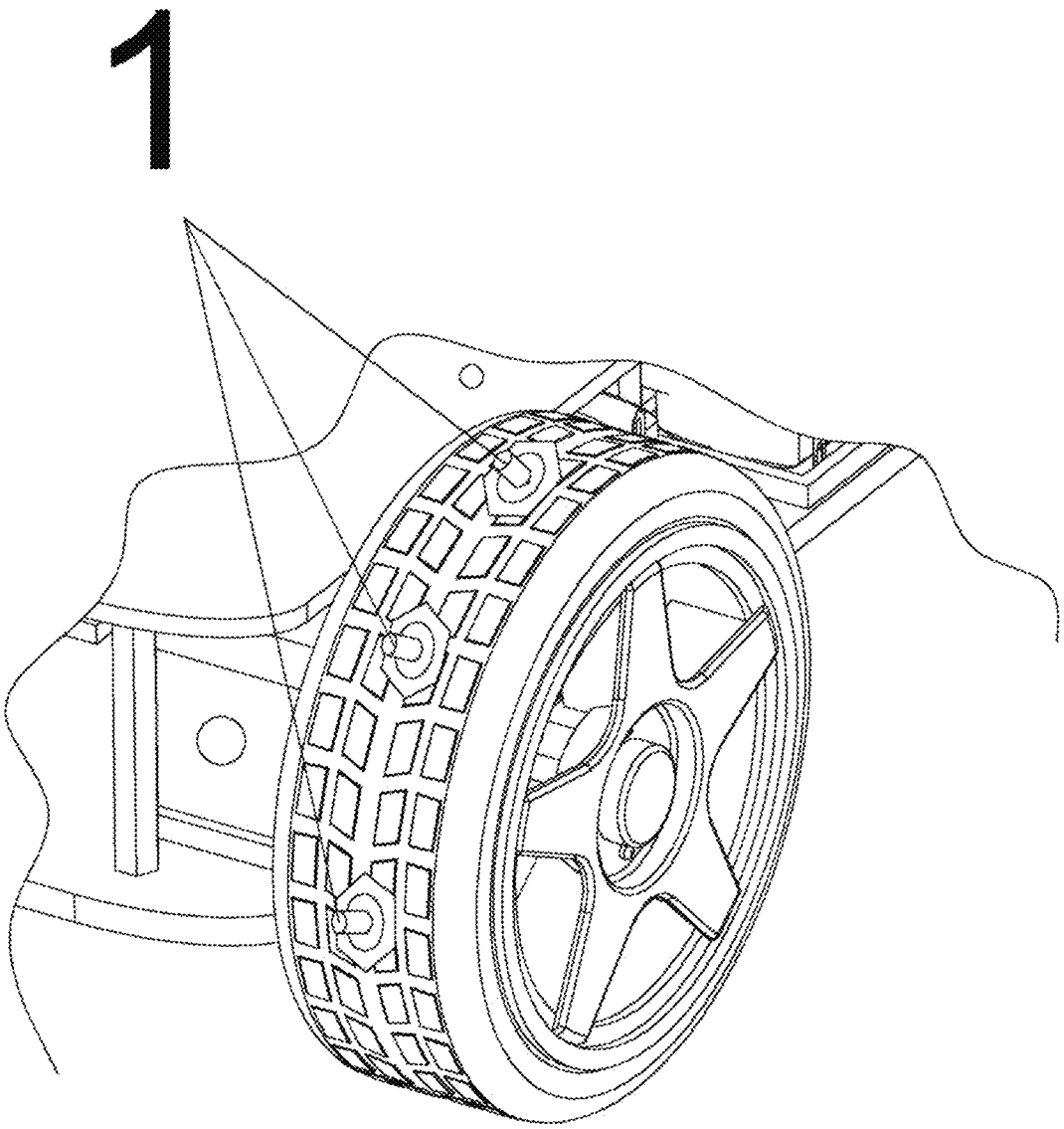
FIG. 22 is a partial schematic diagram of the anti-slip structure applied to a toy car wheel according to an embodiment of the present invention.

Applications of Anti-slip Structure According to Embodiments of the Present Invention FIG. 18 is a structural schematic diagram of the anti-slip structure applied in a trekking pole according to an embodiment of the present invention. FIG. 19 is a structural schematic diagram of the anti-slip structure applied to an anti-slip glove according to an embodiment of the present invention. FIG. 20 is a partial schematic diagram of the anti-slip structure applied to a robot foot sole according to an embodiment of the present invention. FIG. 21 is a top view of the anti-slip structure applied to the bottom of an outdoor case according to an embodiment of the present invention, and FIG. 22 is a partial schematic diagram of the anti-slip structure applied to a toy car wheel according to an embodiment of the present invention. As shown in FIGS. 18, 19, 20, 21 and 22, the applications of the embedded replaceable shock-absorbing anti-slip device according to embodiments of the present invention will be described in detail.

As another aspect of the present invention, there is provided an application of an anti-slip structure, which comprises an application body and the anti-slip structure according to any one of the preceding embodiments that is embedded and replaceably installed on the application body.

In the present embodiment, the device can be specifically applied to trekking poles, wherein the device is capable of effectively absorbing impact forces when the trekking pole contacts the ground, thereby reducing the magnitude of vibration transmission to the user's wrist and shoulder;

The device can also be applied to anti-slip gloves, wherein on smooth ice surfaces or steep rock surfaces, the anti-slip gloves equipped with the device can provide additional gripping force, significantly increasing friction force and preventing hand slippage;

The device can also be applied to robot foot soles, wherein during robot walking motion, by installing the device on the robot foot sole, additional grip can be provided, friction force is significantly increased, slipping is prevented, and falls due to smooth grounds during movement are avoided;

The device can also be applied to the bottom of outdoor camping boxes, wherein during outdoor camping in icy and snowy conditions, by installing the device on the bottom of the outdoor box body, additional grip can be provided, friction force is significantly increased, and sliding of the box body during movement or use is prevented;

The device can also be applied to toy car wheels, wherein when players control toy cars, taking remote control cars as an example, by installing the device on the car wheels, the vehicle's grip and stability on various terrains can be improved, making the vehicle less likely to slip during remote control operation, thereby better maintaining the toy vehicle's balance and control, even on wet or muddy road surfaces.

Usage Method of Shoe Sole with Anti-Slip Structure According to Embodiments of the Present Invention

Usage Method a of Shoe Sole with Anti-Slip Structure

When used on ice surfaces, the stud assembly 1 installed and configured on the outsole of the shoe sole enables strong anti-slip force to be achieved even on ice surfaces. Specifically, the anti-slip studs 131 of the stud assembly 1 make initial contact with the ground to provide a second anti-slip force, increasing the contact area with the ice surface. The stud assembly 1 can penetrate the ice surface to contact the underlying layer beneath the ice surface, thereby providing enhanced anti-slip force. Subsequently, the anti-slip unit 21 contacts the ice surface to provide a first anti-slip force, furnishing additional contact area with the ground for dual anti-slip protection. Through the configured spring 132, adaptive adjustment to ice surfaces with varying irregularities can be achieved to accommodate the ice surface, effectively improving the anti-slip performance on ice surfaces.

Usage Method B of Shoe Sole with Anti-Slip Structure

When used on rocky and dirt mountain paths, the stud assembly 1 installed on the outsole of the shoe sole provides powerful anti-slip force even on rocky and dirt mountain terrain. Specifically, the anti-slip studs 131 of the stud assembly 1 make initial contact with the ground, providing a second anti-slip force and increasing the contact area with the rocky and dirt mountain paths to deliver enhanced anti-slip force. Subsequently, the anti-slip unit 21 contacts the rocky and dirt mountain paths to provide a first anti-slip force, offering additional contact area with the ground for dual anti-slip protection. The configured spring 132 enables adaptive response to varying uneven rock surfaces to accommodate rocky and dirt mountain paths, thereby effectively improving the anti-slip performance on rocky and dirt mountain terrain.

When walking or exercising on various types of uneven irregular surfaces, any stud assembly 1 adapts to the ground through spring 132, with the spring 132 continuously undergoing elastic deformation in response to changes in center of gravity, providing a height Hn between the first height H1 and second height H2, wherein Hn satisfies $H1_Hn \leq H1+H2$, effectively cushioning the impact force from the ground on the sole during walking, and adjusting in real-time according to changes in center of gravity and ground irregularities, thereby providing powerful anti-slip force and reliable motion protection.

The foregoing shows and describes the basic principles and main features of the present invention and the advantages thereof. For those skilled in the art, it is apparent that the present invention is not limited to the details of the above exemplary embodiments, and that the present invention may be implemented in other specific forms without departing from the spirit or essential characteristics of the present invention. Therefore, from any perspective, the embodiments should be regarded as exemplary and non-restrictive, and the scope of the present invention is defined by the appended claims rather than the foregoing description, and accordingly it is intended to embrace all changes that fall within the meaning and scope of equivalents of the claims. Any reference signs in the claims shall not be construed as limiting the claims involved.

Furthermore, it should be understood that although the present specification is described in terms of embodiments, not every embodiment contains only one independent technical solution. This narrative manner of the specification is merely for clarity, and those skilled in the art should regard the specification as a whole. The technical solutions in the various embodiments may also be appropriately combined to form other embodiments that can be understood by those skilled in the art.

What is claimed is:

1. An anti-slip structure, comprising a body (2), wherein on the body (2) an embedded replaceable shock-absorbing anti-slip device for shock absorption and anti-slip function is detachably arranged, which comprises an embedded stud assembly (1), the embedded stud assembly (1) comprises a guide element (11) movably arranged up and down, a fixed base (12), and an anti-slip portion (13) arranged between the guide element (11) and the fixed base (12), the guide element (11) is configured to guide and engage the shock-absorbing anti-slip device, the fixed base (12) is configured to prevent detachment of the shock-absorbing anti-slip device, the anti-slip portion (13) is configured to prevent slipping and grip the ground when contacting the ground; wherein the body (2) comprises a first surface configured to contact the ground and a second surface configured to be attached to a midsole of a shoe sole, the embedded replaceable shock-absorbing anti-slip device being arranged on the first surface of the body (2); wherein the first surface comprises anti-slip units (21) extending from the body (2) of the anti-slip structure toward the ground at a first height H1, for providing first anti-slip force; wherein at least one anti-slip unit (21) comprises an anti-slip block (211), the anti-slip block (211) having an engagement groove (212) formed therein, for detachably installing the embedded stud assembly (1); wherein the guide element (11) comprises a first contact portion (111) and a first connecting portion (112) arranged at the bottom of the first contact portion (111), the first connecting portion (112) having a first receiving groove (113) formed therein; the fixed base (12) is arranged at the bottom of the guide element (11), comprising a seat body (121) and a second receiving groove (122) arranged in the seat body (121), the bottom of the second receiving groove (122) being coaxially provided with a positioning groove (123), and the bottom surface of the seat body (121) being provided with a through hole (124); the seat body (121) has a multi-sided truncated pyramid structure configured to prevent horizontal rotational movement.

2. The anti-slip structure according to claim 1, wherein in a state where the embedded stud assembly (1) is installed in the engagement groove (212), the embedded stud assembly (1) extends from the body (2) of the anti-slip structure toward the ground for a second height H2, for providing a second anti-slip force.

3. The anti-slip structure according to claim 1, wherein in a state where the embedded stud assembly (1) is installed in the engagement groove (212), the embedded stud assembly (1) extends from the body (2) of the anti-slip structure toward the ground for a height between the first height H1 and the second height H2, for providing an adaptive second anti-slip force.

4. The anti-slip structure according to claim 3, wherein the first connecting portion (112) is movably arranged in the second receiving groove (122), the through hole (124) and the positioning groove (123) are axially communicated with each other.

5. The anti-slip structure according to claim 4, wherein the outer wall of the first connecting portion (112) is provided with a first limiting ring, the inner wall of the second receiving groove (122) is provided with a second limiting ring that is buckled and fitted with the outer wall of the first connecting portion (112); the diameter of the second receiving groove (122) is greater than that of the positioning groove (123), and the diameter of the positioning groove (123) is greater than that of the through hole (124); the first contact portion (111) is shaped as a hemisphere.

6. The anti-slip structure according to claim 4, wherein the anti-slip portion (13) comprises an anti-slip stud (131), an outer wall of the anti-slip stud (131) is provided with a radially extending limiting flange (133) adapted to the positioning groove (123); wherein, the anti-slip stud (131) is fixedly embedded within the positioning groove (123) with one end penetrating through the through hole (124), and the other end extending into the first receiving groove (113) and abutting against the top wall of the first receiving groove (113).

7. The anti-slip structure according to claim 4, wherein the anti-slip portion (13) comprises an anti-slip stud (131), an outer wall of the anti-slip stud (131) is provided with a radially extending limiting flange (133) adapted to the positioning groove (123), the anti-slip portion (13) further comprises a spring (132), with one end of the spring (132) embedding within the first receiving groove (113), and the other end fitting on the anti-slip stud (131) and abutting against the top surface of the limiting flange (133); wherein the anti-slip stud (131) is embedded within the positioning groove (123) with one end penetrating through the through hole (124), and the other end retractably arranging in the second receiving groove (122) via the spring (132).

8. The anti-slip structure according to claim 4, wherein a first portion of the first connecting portion (112) is installed within the second receiving groove (122), and a second portion is exposed outside an opening of the second receiving groove (122), such that the second portion, together with a bottom surface of the first contact portion (111) and a top surface of the seat body (121), defines an annular positioning groove (114) configured to prevent upward and downward disengagement; and wherein the anti-slip portion (13) is made of one of steel, plastic, or carbon fiber.

9. The anti-slip structure according to claim 4, wherein during the walking process, when the anti-slip structure contacts the ground, the spring (132) of the embedded stud assembly (1) undergoes adaptive elastic deformation in response to center of gravity changes during the walking process, thereby providing a height between the first height H1 and the second height H2.

10. The anti-slip structure according to claim 4, wherein the engagement groove (212) is a multi-layer structure, with a positioning block (215) adapted to the annular positioning groove (114) provided between the upper and lower layers of the engagement groove (212), the positioning block (215) dividing the engagement groove (212) into an upper groove (2121) and a lower groove (2122) that are arranged one above other, wherein the shapes of the upper and lower layers are respectively adapted to the first connecting portion (112) and the seat body (121).

11. The anti-slip structure according to claim 10, wherein when the embedded stud assembly (1) is engaged into the engagement groove (212), its first contact portion (111) is guided into the upper groove (2121), and the positioning block (215) and the annular positioning groove (114) mutually engage with each other for restricting axial movement of the embedded stud assembly (1).

12. The anti-slip structure according to claim 11, wherein when the embedded stud assembly (1) is engaged into the engagement groove (212), its seat body (121) cooperatively engages into the lower groove (2122), wherein the lower groove (2122) has a polygonal groove shape adapted to the seat body (121), forming a geometric constraint on the embedded stud assembly (1) for restricting horizontal rotational movement of the embedded stud assembly (1).

13. The anti-slip structure according to claim 4, wherein the bottom wall of the engagement groove (212) protrudes upward, forming a spherical protrusion (213) on the top surface of the body (2), for providing space to accommodate the embedded stud assembly (1), the depth of the space being related to the height of the embedded stud assembly (1).

14. The anti-slip structure according to claim 4, wherein a prying groove (214) is formed by extending outward from an inner wall on either side of the engagement groove (212); the anti-slip units (21) are respectively distributed in fractal geometry on the forefoot and rearfoot of the body (2); the bottom of the body (2) is further provided with a plurality of anti-slip treads (22) for enhancing slip resistance and ground grip.

15. The anti-slip structure according to claim 4, wherein it further comprises an installation and removal auxiliary tool (3) for installing and removing the embedded stud assembly (1), the installation and removal auxiliary tool (3) comprises a prying portion (31) and a gripping portion (32), the gripping portion (32) having a positioning hole (33) provided at the bottom thereof for assisting installation.

16. The anti-slip structure according to claim 4, wherein the anti-slip structure is prepared primarily with rare earth cis-polybutadiene rubber and/or nitrile rubber.

17. A shoe sole, comprising a midsole (4), the midsole (4) having a first surface configured to contact an instep and a second surface configured to contact an anti-slip structure according to any one of claims 1-16, wherein the anti-slip structure comprises a protrusion (213), and; wherein the second surface of the midsole (4) has at least one recess (411) adapted to the protrusion (213).

18. The shoe sole according to claim 17, wherein the recess (411) is configured to provide space for accommodating the protrusion (213), wherein the depth of the space is positively correlated with the height of the protrusion (213) that accommodates the embedded stud assembly (1);

the body (2) and the midsole (4) are joined by one of adhesive bonding, heat fusion, or stitching.

19. The shoe sole according to claim 17, wherein the embedded stud assemblies (1) are arranged within the anti-slip unit (21) in the forefoot of the shoe sole in a fractal geometry arrangement centered on at least two embedded stud assemblies (1), and the embedded stud assemblies (1) are arranged within the anti-slip unit (21) in the rearfoot of the shoe sole in a fractal geometry arrangement centered on at least one embedded stud assembly (1).

20. The shoe sole according to claim 17, wherein the body (2), midsole (4) and embedded stud assembly (1) are manufactured using a layered processing method.

* * * * *